US007277651B2

(12) United States Patent
Hanamoto et al.

(10) Patent No.: US 7,277,651 B2
(45) Date of Patent: Oct. 2, 2007

(54) IMAGE FORMING APPARATUS AND CONTROL METHOD WITH POWER CONTROLLED IN ACCORDANCE WITH REMAINING AMOUNT OF RECHARGEABLE BATTERY POWER

(75) Inventors: Hidetoshi Hanamoto, Susono (JP); Satoru Koyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 118 days.

(21) Appl. No.: 11/046,816

(22) Filed: Feb. 1, 2005

(65) Prior Publication Data

US 2005/0169657 A1 Aug. 4, 2005

(30) Foreign Application Priority Data

Feb. 4, 2004 (JP) ..... 2004-028531

(51) Int. Cl.
*G03G 15/00* (2006.01)
*G03G 15/20* (2006.01)

(52) U.S. Cl. ..... 399/69; 399/70; 399/88

(58) Field of Classification Search ..... 399/67, 399/69, 70, 88, 90
See application file for complete search history.

(56) References Cited

U.S. PATENT DOCUMENTS 3,973,845 A 8/1976 Lindblad et al.
5,153,654 A 10/1992 Yuminamochi et al.
5,177,549 A 1/1993 Ohtsuka et al.
5,179,397 A 1/1993 Ohzeki et al. ..... 346/160
5,196,885 A 3/1993 Takeuchi et al.
5,223,900 A 6/1993 Yuminamochi et al.
5,331,385 A 7/1994 Ohtsuka et al.
5,543,904 A 8/1996 Kato et al.
5,899,610 A 5/1999 Enomoto et al. ..... 399/302
5,923,939 A 7/1999 Koyama ..... 399/308
5,995,793 A 11/1999 Enomoto et al. ..... 399/302

(Continued)

FOREIGN PATENT DOCUMENTS

JP 51-109739 9/1976

(Continued)

OTHER PUBLICATIONS

Korean Official Action in Korean Application No. 10-2005-0009839.

*Primary Examiner*—William J. Royer
(74) *Attorney, Agent, or Firm*—Fitzpatrick, Cella, Harper & Scinto

(57) ABSTRACT

There are provided an image forming apparatus which can implement on-demand fusing with quick rise in temperature by using the upper current (power) limit of a commercial power supply more effectively and a control method for the apparatus. This image forming apparatus includes a rechargeable battery device capable of charging and discharging, and is designed such that a load other than heating element of a fusing device can receive power from the commercial power supply and/or the rechargeable battery device. When printing is to be executed, the temperature of the fusing device is detected by a temperature detection element provided for the fusing device, and the supply of power from the commercial power supply or rechargeable battery device to the load is controlled in accordance with the detected temperature. The power supplied from the commercial power supply to the fusing device is then limited to a limit level corresponding to the control result.

10 Claims, 29 Drawing Sheets

U.S. PATENT DOCUMENTS

| | | | | |
|---|---|---|---|---|
| 6,005,594 | A | 12/1999 | Nanataka et al. | 347/156 |
| 6,016,418 | A | 1/2000 | Kabeya et al. | 399/314 |
| 6,088,567 | A | 7/2000 | Miyashiro et al. | 399/400 |
| 6,097,919 | A | 8/2000 | Takeuchi et al. | 399/298 |
| 6,151,476 | A | 11/2000 | Tsuruya et al. | 399/302 |
| 6,151,477 | A | 11/2000 | Takeuchi et al. | 399/318 |
| 6,175,702 | B1 | 1/2001 | Takeuchi et al. | 399/101 |
| 6,347,211 | B2 | 2/2002 | Nanataki et al. | 399/328 |
| 6,473,574 | B1 | 10/2002 | Usui et al. | 399/66 |
| 6,505,027 | B2 | 1/2003 | Takeuchi et al. | 399/328 |
| 6,542,705 | B2 * | 4/2003 | Fujita et al. | 399/69 |
| 6,639,195 | B2 | 10/2003 | Abe et al. | 219/619 |
| 6,704,537 | B2 | 3/2004 | Takeuchi et al. | 399/328 |
| 6,775,509 | B2 | 8/2004 | Shida et al. | 399/328 |
| 6,801,741 | B2 | 10/2004 | Enomoto et al. | 399/302 |
| 6,847,792 | B2 * | 1/2005 | Nakafuji et al. | 399/88 |
| 6,925,271 | B2 | 8/2005 | Suzuki et al. | 399/69 |
| 6,937,837 | B2 | 8/2005 | Takeuchi et al. | 399/328 |
| 6,941,088 | B2 * | 9/2005 | Atsushi et al. | 399/69 |
| 6,947,699 | B2 | 9/2005 | Suzuki et al. | 399/329 |
| 6,952,548 | B2 | 10/2005 | Uchida et al. | 399/173 |
| 7,002,112 | B2 | 2/2006 | Kishi et al. | 219/482 |
| 7,054,570 | B2 * | 5/2006 | Kishi et al. | 399/67 |
| 2002/0056960 | A1 | 5/2002 | Bergeron et al. | 271/145 |
| 2005/0135830 | A1 | 6/2005 | Koyama | 399/88 |
| 2005/0169655 | A1 | 8/2005 | Koyama et al. | 399/69 |
| 2005/0169657 | A1 | 8/2005 | Hanamoto et al. | 399/88 |
| 2005/0169658 | A1 | 8/2005 | Hanamoto et al. | 399/88 |
| 2005/0169659 | A1 | 8/2005 | Koyama et al. | 399/88 |
| 2006/0091130 | A1 | 5/2006 | Kishi et al. | 219/482 |

FOREIGN PATENT DOCUMENTS

| | | |
|---|---|---|
| JP | 7-41023 | 2/1995 |
| JP | 2002-56960 | 2/2002 |
| JP | 2002-162854 | 6/2002 |
| JP | 2002-174988 | 6/2002 |
| JP | 2003-257590 | 9/2003 |
| JP | 2003-297526 | 10/2003 |

* cited by examiner

IMAGE FORMING APPARATUS AND CONTROL METHOD WITH POWER CONTROLLED IN ACCORDANCE WITH REMAINING AMOUNT OF RECHARGEABLE BATTERY POWER

FIELD OF THE INVENTION

The present invention relates to an image forming apparatus and its control method and, more particularly, to an image forming apparatus using an electrophotographic process and a control method.

BACKGROUND OF THE INVENTION

An image forming apparatus using an electrophotographic process, e.g., a laser beam printer, comprising a fusing device which thermal-fuses a toner image formed on a printing medium (e.g., a printing sheet or OHP sheet). A heating system which can be used for the fusing device includes several types. Of these types, an electromagnetic induction heating system which induces a current in a fusing roller using a magnetic flux and generates heat using the resultant Joule heat, in particular, can directly cause the fusing roller to generate heat by using the generation of the induced current. This system is advantageous over a fusing device based on a heated roller system using a halogen lamp as a heat source in terms of achieving a high-efficiency fusing process (see, for example, Japanese Utility Model Laid-Open No. 51-109739).

Recently, a color image forming apparatus (A4 apparatus) capable of printing on standard-sized sheets, e.g., A4 size sheets, at a rate of 16 sheets/min has been able to implement a technique of heating the roller only at the time of printing. This is often referred to a "on-demand fusing", which uses a fusing device with a small heat capacity based on the above electromagnetic induction heating system so that no fusing temperature control is required during standby.

On the other hand, in a color image forming apparatus (A3 apparatus) capable of printing on standard-sized sheets up to A3 size, the fusing device is generally required to have a larger heat capacity than the fusing device in an A4 apparatus, although it depends on the printing speed. This apparatus therefore performs preheating by supplying power to the fusing device at predetermined time intervals even during standby, i.e., so-called "standby temperature control" (see, for example, Japanese Patent Laid-Open No. 2002-056960). The following is the reason why standby temperature control is performed.

FIG. 27 shows, for a color image forming apparatus (A3 apparatus) using a fusing device based on a conventional electromagnetic induction heating system, the relationship between the start-up time required for the temperature of the fusing device in a cooled state to reach a temperature at which printing can be done (e.g., 180° C.) and the corresponding power (fusing power) supplied to the heater of the fusing device. Referring to FIG. 27, if the fusing power that can be supplied is about 900 W, the start-up time required to reach a temperature at which printing can be done (print temperature) is 30 sec (point Wa). This time is much shorter than the start-up time required in a commonly used fusing device using a halogen heater. However, if we consider the sheet convey time and the like, the time (first printout time) between the instant at which printing is started and the instant at which the first image-bearing sheet is discharged to a paper discharge unit increases to more than 30 sec, thus making the user wait. For this reason, in order to shorten the first printout time, power is supplied to the fusing device at predetermined time intervals even during standby to perform preheating (as generally done in an image forming apparatus using a fusing device based on the halogen heater system). Executing this standby temperature control makes it possible to quickly reach a predetermined fusing temperature, at which image forming can be performed, once a printing job is started.

The power consumption at the time of standby temperature control in the electromagnetic induction heating system can be suppressed low because the temperature at the time of standby temperature control can be set to be lower than that in the fusing system using a halogen heater. As compared with the on-demand fusing system, however, this system still requires extra power (power at the time of standby temperature control).

In this image forming apparatus, if the power supplied to the heater of the fusing device can be increased by about 200 W, a power of 1,100 W can be supplied to the fusing device, and the time taken to reach the print temperature becomes about 15 sec (a point Wb in FIG. 27). If, therefore, the target first printout time for this image forming apparatus is about 20 sec, on-demand fusing which requires no standby temperature control can be realized (although it depends on the arrangement, the paper convey paths, the convey speed, and the like of the image forming apparatus).

With the recent technical improvements in image forming apparatuses, even image forming apparatuses in the category of medium-speed apparatuses (middle-class apparatuses) have been reduced in size and cost and increased in speed. The printing speeds of such apparatuses have reached those of high-speed apparatuses a decade ago. Along with this tendency, the market has further demanded value added such as energy saving and a reduction in first printout time.

In light of this, even by using a fusing device based on the high-efficiency electromagnetic induction heating system or on-demand fusing, which has been implemented in conventional A4 apparatus, has become difficult to meet such market demands.

As described above, in an A3 apparatus using conventional standby temperature control practice, power is supplied to the fusing device during standby even though the necessary power is minimum. Therefore, this standby temperature control constitutes one of the factors that makes it difficult to reduce the power consumption of the image forming apparatus during standby.

However, in the case where power saving is important during standby and the standby temperature control is not executed, it takes more time to reach a predetermined fusing temperature, at which image forming can be done. As a consequence, another problem arises, that is, the first printout time becomes longer. In other words, there is a tradeoff between energy saving during standby and a reduction in first printout time.

An on-demand fusing system balancing energy saving during standby and reducing the first printout time, which comprises a short temperature rise time suited for the market levels needs to be developed.

Although a large-size, high value-added image forming apparatus such as high-speed monochrome printing apparatuses or high-quality color printing apparatuses, i.e., so-called high-speed apparatuses (high-class apparatuses), are devised to save energy, but also comprise value added such as high performance devices and abundant optional supply of equipment. That is, there is a tendency toward increasing power consumption. One of the criteria for determining the upper limit of the power consumption of such an apparatus is the maximum current that can be supplied by the commercial power supplies. Assume that a maximum supply current of 15 A is specified for a 100-V commercial power supply. In this case, the upper power limit is 1,500 W (=100 V×15 A). An image forming apparatus is generally designed such that the maximum current, that the apparatus requires, does not exceed the maximum current of the commercial power supply.

For high-speed apparatus class fusing devices, a fusing device with a larger heat capacity is generally used to stand high-speed continuous fusing. The inconvenience of such a fusing device is that it takes a long period of time (several minutes) (warm-up time) for the temperature of the fusing device, in a cooled state, to reach a temperature in a standby state. One of the challenges to overcome this is to shorten the warm-up time.

Assume that the warm-up time of the fusing device is to be shortened by simply supplying large power. In this case, since the maximum power of the commercial power supply defines the upper power limit that can be used, it is difficult to further shorten the warm-up time unless the fusing device itself is improved.

For example, as a proposal to solve such a problem, Japanese Utility Model Publication No. 7-41023 discloses that in order to effectively use power for a fusing device, an image forming apparatus whose fusing device includes a main heater and a sub-heater is provided with a rechargeable battery unit, and the rechargeable battery unit is designed to selectively connect to a DC power supply or DC motor control unit. More specifically, while the rechargeable battery unit is supplying power to the DC motor, power that should be supplied to the DC motor can be supplied to the sub-heater, and hence the temperature of the fusing device can be raised higher than in the prior art. During this period, copying can be done at high speed.

In addition, Japanese Patent Laid-Open No. 2002-174988 discloses a method of achieving energy saving and a reduction in print start time by providing a rechargeable battery device for an image forming apparatus and using both power from a commercial power supply and power from the rechargeable battery device during startup of a fusing device.

According to the arrangements disclosed in Japanese Utility Model Publication No. 7-41023 or Japanese Patent Laid-Open No. 2002-174988, since the power supplied from the rechargeable battery means to the sub-heater or a predetermined load is simply turned on/off, the maximum power that can be supplied from the commercial power supply may not be effectively used depending on the voltage of the commercial power supply to which the image forming apparatus is connected to or the load condition of the image forming apparatus. In addition, the arrangement of the fusing device is complicated because it requires a plurality of heaters.

Furthermore, in an image forming apparatus whose fusing device includes a main heater and a sub-heater, when the fusing device is to be started up without sufficient power stored in the rechargeable battery device, there is a chance that no power will be supplied to the sub-heater or the loads of the image forming apparatus other than the fusing device. If no power can be supplied to the sub-heater, the sub-heater portion will also be heated by the main heater. Thus, it may require longer startup time than in a conventional fusing device having no rechargeable battery device. Furthermore, if the required power cannot be supplied to the loads of the image forming apparatus other than the fusing device, the image forming apparatus may not normally operate.

SUMMARY OF THE INVENTION

The present invention fulfills the above-described and other needs by providing an image forming apparatus and its control method that can implement on-demand fusing with quick rise in temperature by using the upper current (power) limit of a commercial power supply more effectively. In exemplary embodiments, the image forming apparatus includes a rechargeable battery device capable of charging and discharging, and is designed such that a load other than the heating element of a fusing device can receive power from the commercial power supply and/or the rechargeable battery device. When printing is to be executed, the temperature of the fusing device is detected by a temperature detection element provided for the fusing device, and the supply of power from the commercial power supply or rechargeable battery device to the load is controlled in accordance with the detected temperature. The power supplied from the commercial power supply to the fusing device is then limited to a limit level corresponding to the control result.

Other and further objects, features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principle of the invention.

DETAILED DESCRIPTION OF THE PREFERRED EMBODIMENTS

Preferred embodiments of the present invention will now be described in detail in accordance with the accompanying drawings. Note that a laser beam printer will be exemplified as an embodiment of the present invention. However, the present invention is not limited to the laser beam printer, and can be applied to image forming apparatuses, on the whole, which use the electrophotographic process.

First Embodiment

<Schematic Arrangement of Laser Beam Printer 100>

Figure 1:
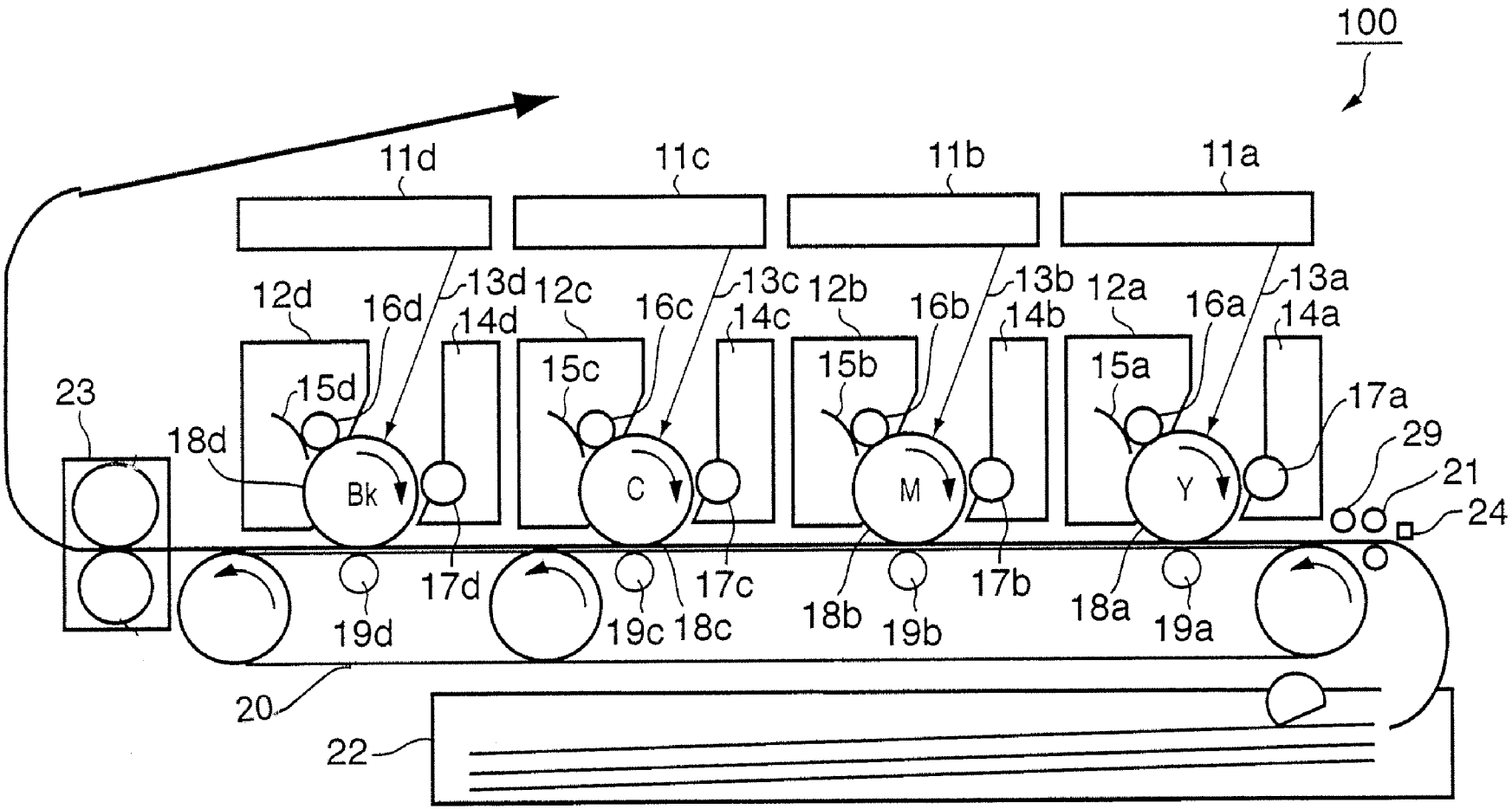
FIG. 1 is a view showing the schematic arrangement of a laser beam printer according to an embodiment of the present invention.

FIG. 1 is a view showing the schematic arrangement of a laser beam printer 100 according to an embodiment of the present invention. The laser beam printer 100 is a so-called tandem type printer provided with image forming units 12*a*, 12*b*, 12*c*, 12*d* for the respective color images, i.e., a black image (BK), yellow image (Y), magenta image (M), and cyan image (C).

The image forming units are comprised of photoconductive drums 18*a-d*, primary chargers 16*a-d* which uniformly charges the photoconductive drum 18*a-d*, scanner units 11*a-d* which project light beams 13*a*-13*d*, respectively, to form latent images on the respective photoconductive drums 18*a-d*, developing devices 14*a-d* which applies toner with rollers 17*a*-17*d* to develop the latent image into a visual image, a transfer device 19*a-d* which transfers the visual image onto a transfer sheet, a cleaning device 15*a-d* which removes residual toner from the photoconductive drum, and the like.

Figure 2:
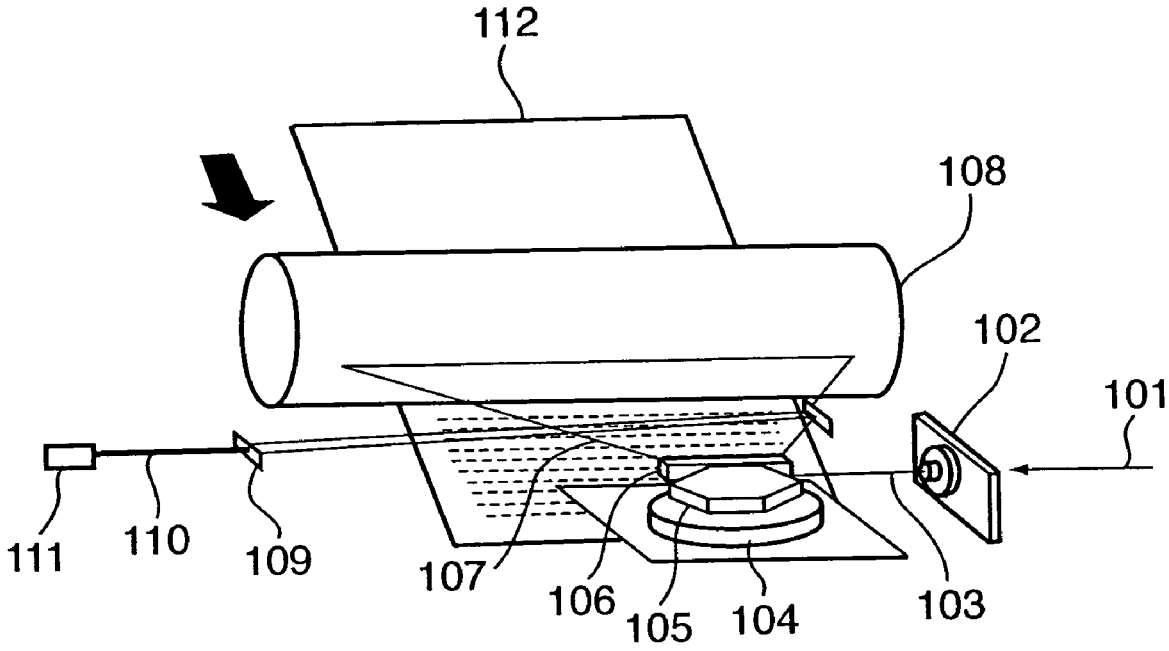
FIG. 2 is a view showing the arrangement of a scanner unit of the laser beam printer according to the embodiment.

The arrangement of the scanner unit 11*a-d* will be described. FIG. 2 is a view showing the arrangement of the scanner unit 11*a-d*. Upon reception of an instruction to form an image from an external device (not shown) such as a personal computer, the controller (not shown) in the laser beam printer 100 converts image information into an image signal (VDO signal) 101 for turning on/off a laser beam serving as an exposure means. The image signal (VDO signal) 101 is input to a laser unit 102 in the scanner unit 11*a-d*. Reference numeral 103 denotes a laser beam on/off-modulated by the laser unit 102; a scanner motor 104 which steadily rotates a rotating polyhedral mirror (polygon mirror) 105; and 106, an imaging lens which focuses a laser beam 107 deflected by the polygon mirror 105 onto the photoconductive drum 18*a-d* which is a surface to be scanned.

With this arrangement, the laser beam 103 modulated by the image signal 101 is horizontally scanned (scanned in the main scanning direction) on the photoconductive drum 18*a-d* to form a latent image on the photoconductive drum 18*a-d* for transfer to sheet 112.

Reference numeral 109 denotes a beam detection port which is a slit-like incident port through which a beam is received. The laser beam 107 which has entered this incident port is guided to a photoelectric conversion element 111 through an optical fiber 110. The laser beam 107 converted into an electric signal by the photoelectric conversion element 111 is amplified by an amplifying circuit (not shown) to become a horizontal sync signal.

Referring back to FIG. 1, a transfer sheet serving as a printing medium fed from a cassette 22 is waited at registration rollers 21 to be timed to the image forming unit.

A registration sensor 24 for detecting the leading end of a fed transfer sheet is provided near the registration rollers 21. An image forming control unit (not shown) which controls the image forming unit detects, on the basis of the detection result from the registration sensor 24, the timing at which the leading end of the sheet has reached the registration rollers 21, and performs control to form an image of the first color (yellow in the case shown in FIG. 1) on a photoconductive drum 18*a* serving as an image carrier and set the temperature of the heater (not shown) of a fusing device 23 to a predetermined temperature.

Reference numeral 29 denotes an attraction roller. An attraction bias is applied to the shaft of the attraction roller 29 to make the transfer sheet be electrostatically attracted onto a convey belt 20.

The transfer sheet which has been waiting at the registration rollers 21 is conveyed on the convey belt 20 extending through the respective image forming units in accordance with the detection result from the registration sensor 24 and the timing of an image forming process, and an image of a first color is transferred onto the transfer sheet by a transfer device 19*a*.

Likewise, an image of a second color (magenta in the case shown in FIG. 1) is superimposed/transferred onto the image of the first color on the transfer sheet conveyed on the convey belt 20 in accordance with the detection result from the registration sensor 24 and the timing of the second color image forming process. Subsequently, in the same manner, an image of a third color (cyan in the case shown in FIG. 1) and an image of a fourth color (black in the case shown in FIG. 1) are sequentially superimposed/transferred onto the transfer sheet in accordance with the timings of the corresponding image forming processes.

The transfer sheet on which the toner images have been transferred is conveyed to the fusing device 23. When this transfer sheet passes through a nip portion N (to be described in detail later in FIG. 4) of the fusing device 23, the toner is pressurized and heated to be fused on the transfer sheet. The transfer sheet which has passed through the fusing device 23 is discharged out of the apparatus, thus completing the full-color image forming process.

<Arrangement of Fusing Device 23>

Figure 4:
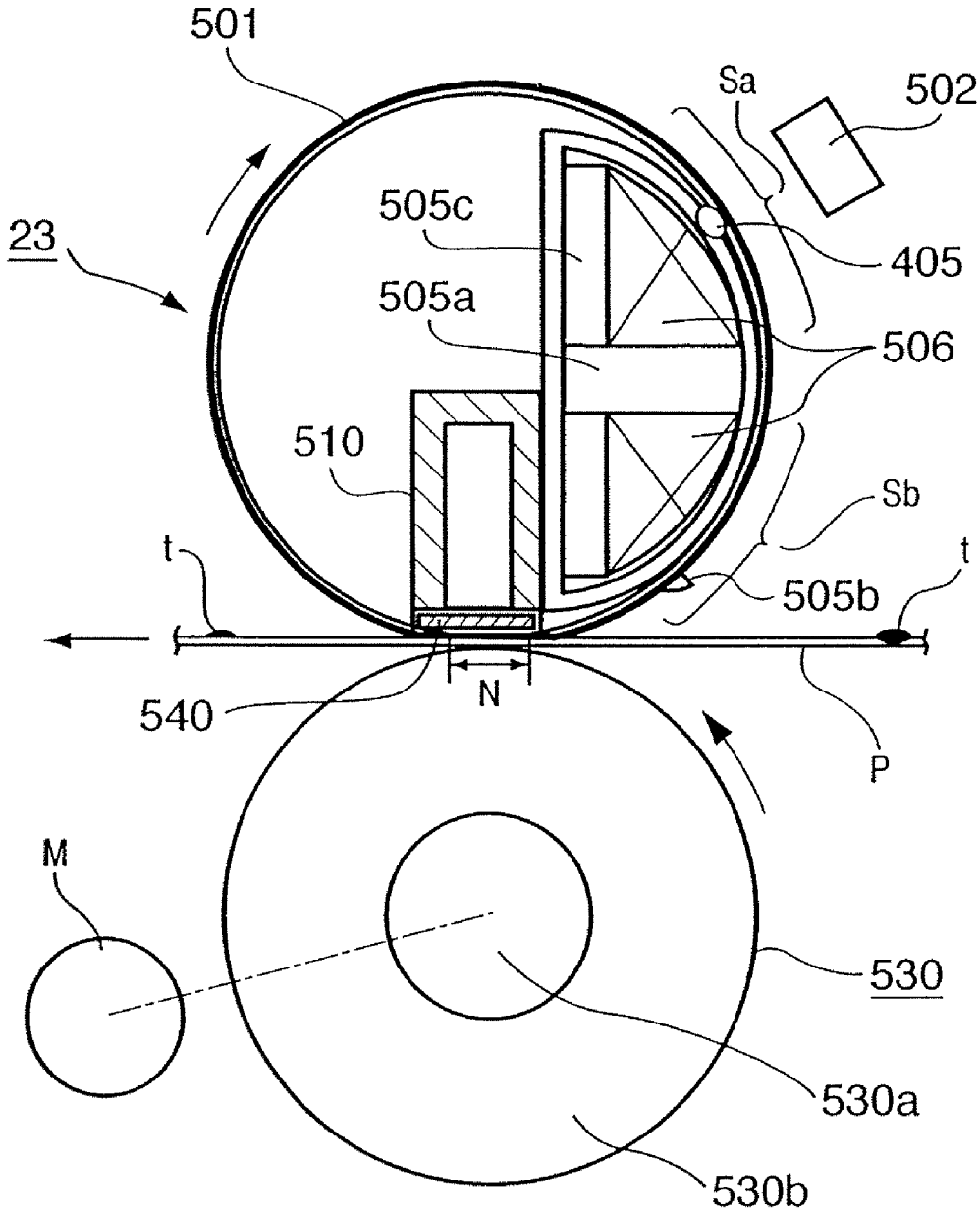
FIG. 4 is a view showing the cross-sectional structure of a fusing device in the embodiment.
Figure 5:
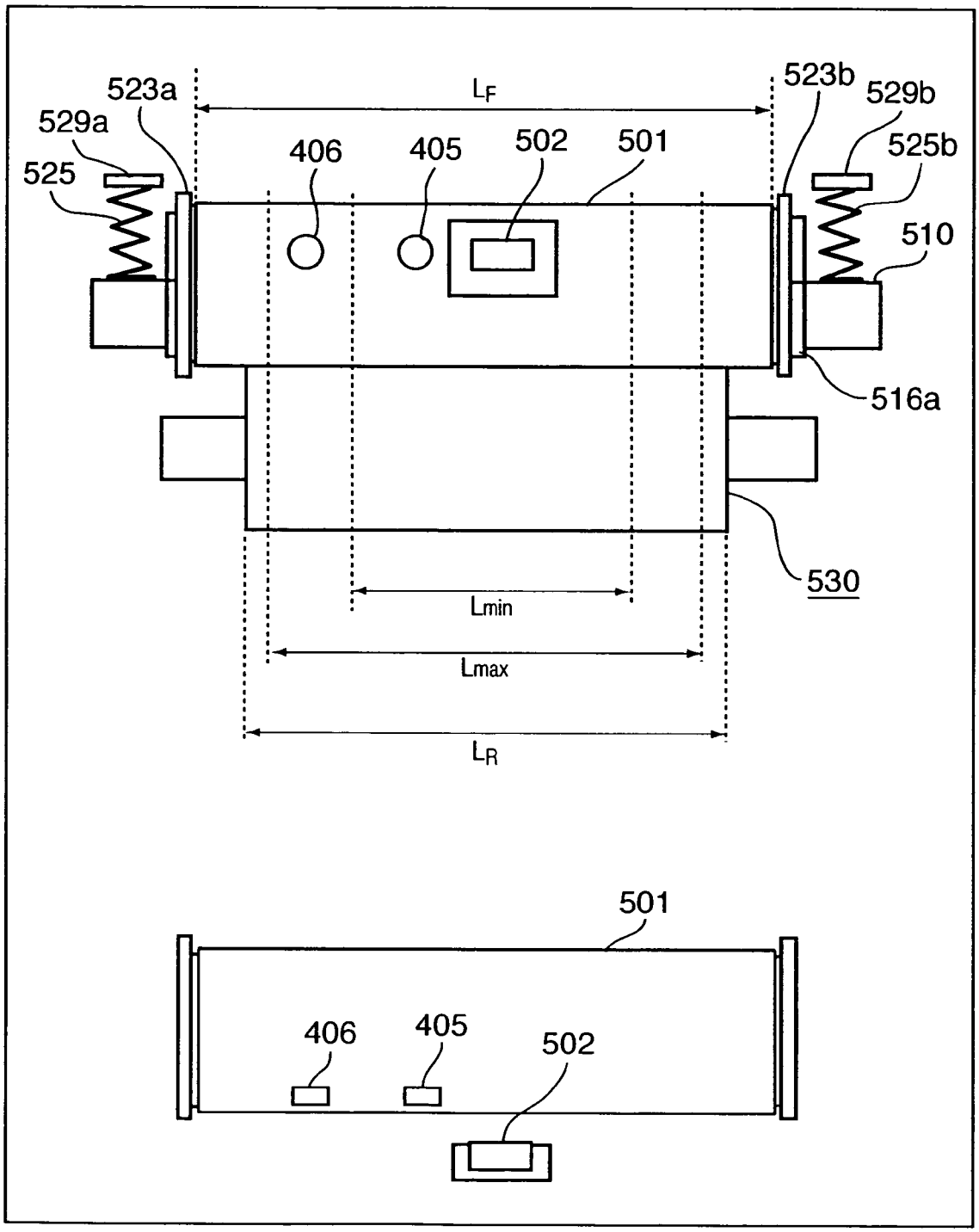
FIG. 5 is a view showing the structure of the fusing device according to the embodiment when viewed from the front.
Figure 6:
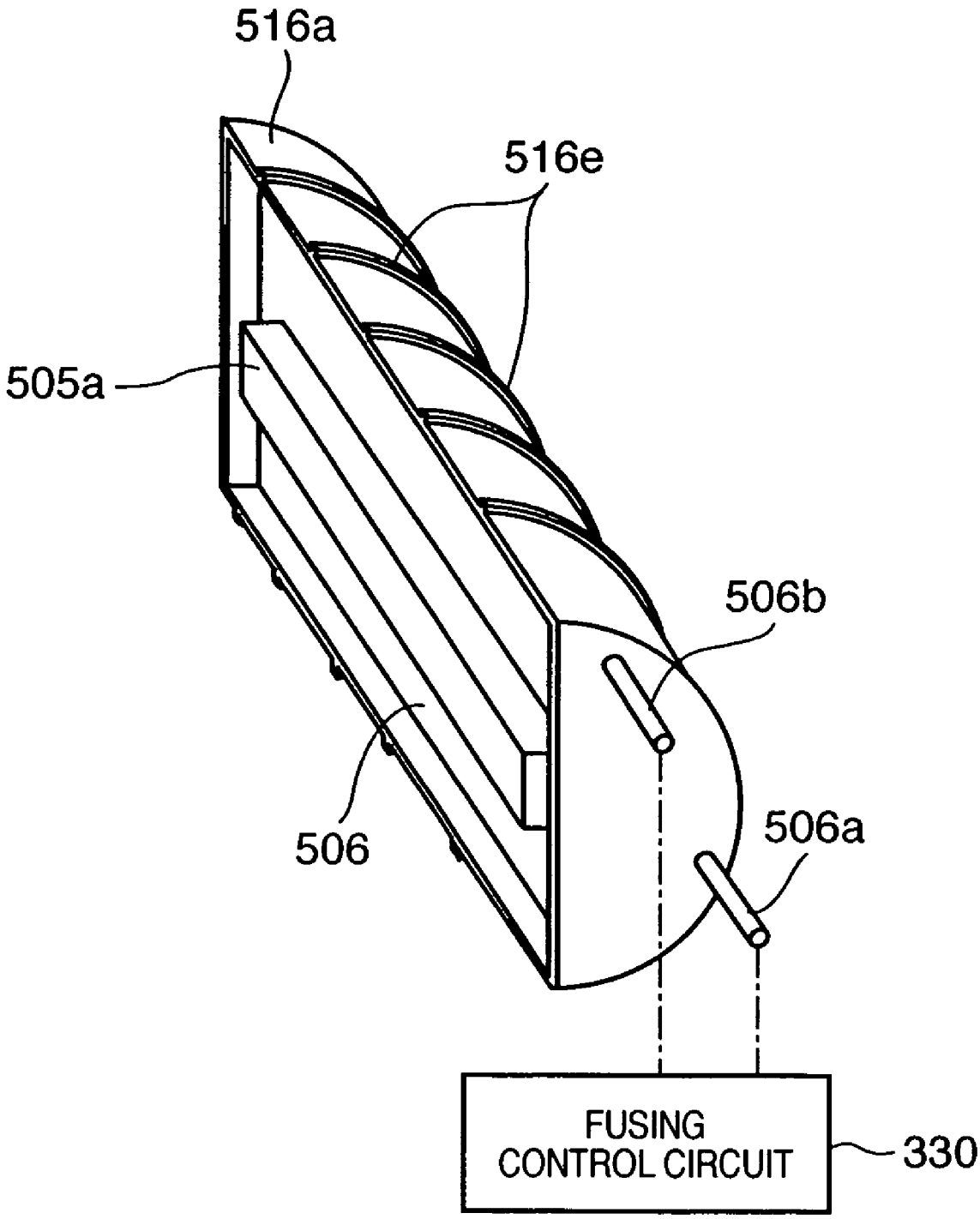
FIG. 6 is a view showing a fusing belt guide member as a component of the fusing device in the embodiment.

The fusing device 23 in this embodiment uses an electromagnetic induction heating system which is more efficient than a heated roller system using a halogen lamp as a heat source. An example of the structure of the fusing device 23 will be described with reference to FIGS. 4 to 6. FIG. 4 is a view showing the cross-sectional structure of the main part of the fusing device 23. FIG. 5 is a view showing the structure of the main part of the fusing device 23 when viewed from the front. FIG. 6 is a perspective view showing a fusing belt guide member as a part of the fusing device 23.

Reference numeral 501 denotes a cylindrical fusing belt serving as an electromagnetic induction heating rotating member having an electromagnetic induction heating layer (a conductive layer, magnetic layer, and resistive layer). A specific example of the structure of the fusing belt 501 will be described later.

Reference numeral 516*a* denotes a belt guide member in the form of a tub having an almost semicircular cross-section. The cylindrical fusing belt 501 is loosely fitted on the belt guide member 516*a*. The belt guide member 516*a* basically has the following functions: (1) pressurizing the fusing nip portion N formed by press contact with an elastic pressurized roller 530 (to be described later), (2) supporting exciting coils 506 and magnetic cores 505*a*, 505*b*, 505*c*, which serve as a magnetic field generating means, (3) supporting the fusing belt 501, and (4) ensuring the conveyance stability of the fusing belt 501 when it rotates. In order to implement these functions, the belt guide member 516*a* is preferably formed by using a material that can resist a high load and has excellent insulating properties and good heat resistance. It suffices to select one of the following materials: phenol resin, fluoroplastic, polyimide resin, polyamide resin, polyamideimide resin, PEEK resin, PES resin, PPS resin, PFA resin, PTFE resin, FEP resin, LCP resin, and the like.

The belt guide member 516*a* holds in it a magnetic core (formed into a T shape using core members 505*a*, 505*b*, and 505*c*) and the exciting coil 506 which serve as a magnetic field generating means. The belt guide member 516*a* is also provided with a good thermal conductive member (e.g., an aluminum material) 540 which is longitudinal in the direction perpendicular to the drawing surface and is placed inside the fusing belt 501 so as to be located on that surface of the nip portion N which faces the pressurized roller 530. The good thermal conductive member 540 has an effect of making a temperature distribution in the longitudinal direction uniform.

Flange members 523*a* and 523*b* shown in FIG. 5 are fitted on the left and right end portions of the assembly of the belt guide member 516*a* to fix its left and right positions so as to make it rotatable, and serve to restrict the sliding movement of the fusing belt 501 along the longitudinal direction of the belt guide member 516*a* at the time of the rotation of the fusing belt 501 by bearing the end portions of the fusing belt 501.

Reference numeral 530 denotes the elastic pressurized roller serving as a pressurizing member, which is pressed against the lower surface of the belt guide member 516*a* through the fusing belt 501 with a predetermined pressing force so as to form the fusing nip portion N with a predetermined width. In this case, the magnetic core 505 is placed at a position corresponding to the fusing nip portion N. The pressurized roller 530 is comprised of a cored bar 530*a* and a heat-resistant/elastic material layer 530*b* which is made of silicone rubber, fluorine, fluoroplastic, or the like and integrally and concentrically formed around a first outside wiring. The two end portions of the cored bar 530*a* are rotatably borne/held between chassis-side sheet metal members (not shown) of the apparatus. Pressurized springs 525*a* and 525*b* are contracted/provided between the two end portions of a pressurizing rigid stay 510 and spring bearing members 529*a* and 529*b* on the apparatus chassis side to apply a downward pushing force to a pressurizing rigid stay 510. This makes the lower surface of the belt guide member 516*a* come into tight contact with the upper surface of the pressurized roller 530 so as to clamp the fusing belt 501, thereby forming the fusing nip portion N with the predetermined width.

The pressurized roller 530 is rotated/driven in the counterclockwise direction indicated by the arrow by a driving motor M. With this rotating/driving operation, a rotating force acts on the fusing belt 501 due to the frictional force between the pressurized roller 530 and the outer surface of the fusing belt 501. The fusing belt 501 circumferentially rotates on the belt guide member 516*a* at a peripheral speed almost corresponding to the rotational peripheral speed of the pressurized roller 530 in the clockwise direction indicated by the arrow while the inner surface of the fusing belt 501 slidably moves on the lower surface of the belt guide member 516*a* in tight contact therewith at the fusing nip portion N (pressurized roller driving system). In addition, as shown in FIG. 6, convex rib portions 516*e* are formed on the circumferential surface of the belt guide member 516*a* at predetermined intervals in the longitudinal direction to reduce the contact sliding friction between the circumferential surface of the belt guide member 516*a* and the inner surface of the fusing belt 501, thereby reducing the rotational load on the fusing belt 501.

As the exciting coil 506, a coil formed from a bundle of thin copper wires, each of which is a conducting wire (electric wire) as an element of the coil and is insulated/coated, is used, which is wound by a plurality of turns. Each wire is preferably insulated/coated with a heat-resistant coating in consideration of the conduction of the heat generated by the fusing belt 501. For example, an amide-imide or polyimide coating is preferably used. The density of the exciting coil 506 may be increased by externally pressurizing it.

As shown in FIG. 4, the shape of the exciting coil 506 conforms to the curved surface of the heating layer. In this embodiment, the distance between the heating layer of the fusing belt 501 and the exciting coil 506 is set to about 2 mm.

The absorption efficiency of a magnetic flux increases with a decrease in the distance between the core members 505*a*, 505*b*, and 505*c*, the exciting coil 506, and the heating layer of the fusing belt 501. If this distance exceeds 5 mm, this efficiency considerably decreases. Therefore, the distance is preferably set to 5 mm or less. The distance between the heating layer of the fusing belt 501 and the exciting coil 506 need not be constant as long as it falls within 5 mm or less. With regard to leader lines 506*a* and 506*b* (FIG. 6) extending from the belt guide member 516*a* serving as an exciting coil holding member for the exciting coil 506, the outsides of the bundles are insulated/coated.

Figure 7:
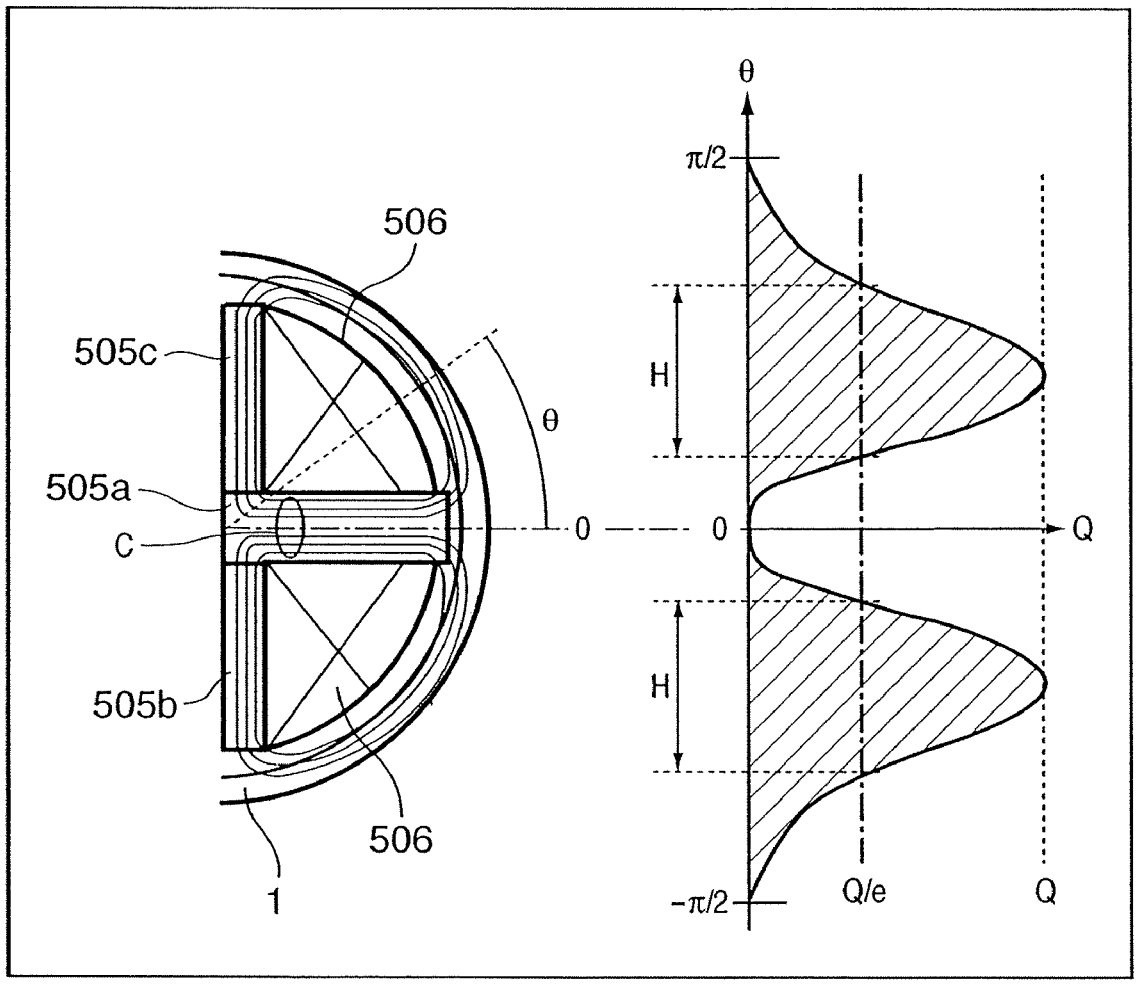
FIG. 7 is a view schematically showing how an alternating magnetic flux is generated.

The exciting coil 506 generates an alternating magnetic flux upon reception of an alternating current supplied from a fusing control circuit (excitation circuit). FIG. 7 is a view schematically showing how an alternating magnetic flux is generated. A magnetic flux C is part of the generated alternating magnetic flux. The magnetic flux C guided to the core members 505*a*, 505*b*, and 505*c* is intensively distributed in regions Sa and Sb in FIG. 4 by the magnetic core members 505*a* and 505*c* and the magnetic core members 505*a* and 505*b*, thereby generating an overcurrent in the electromagnetic induction heating layer 1 of the fusing belt 501. This overcurrent generates Joule heat (overcurrent loss) in the electromagnetic induction heating layer 1 owing to the resistivity of the electromagnetic induction heating layer 1. In this case, a heat value Q is determined by the density of magnetic fluxes passing through the electromagnetic induction heating layer 1, and exhibits a distribution like that shown in the graph on the right side in FIG. 7. The ordinate represents the position on fusing belt 501 in the circumferential direction which is represented by an angle θ with the center of the magnetic core member 505*a* being 0; and the abscissa, the heat value Q in the electromagnetic induction heating layer 1 of the fusing belt 501. In this case, when the maximum heat value is represented by Q, heating regions H (corresponding to the regions Sa and Sb in FIG. 4) are defined as regions in which the heat values are Q/e or more. This heat value is a value necessary for fusing.

A temperature control system including temperature sensors 405 and 406 performs temperature control to keep the temperature of the fusing nip portion N at a predetermined temperature by controlling the supply of current to the exciting coil 506. The temperature sensor 405 shown in FIGS. 4 to 6 is formed from, for example, a thermistor which detects the temperature of the fusing belt 501. In this embodiment, the temperature of the fusing nip portion N is controlled on the basis of the temperature information of the fusing belt 501 measured by the temperature sensor 405.

Figure 8:
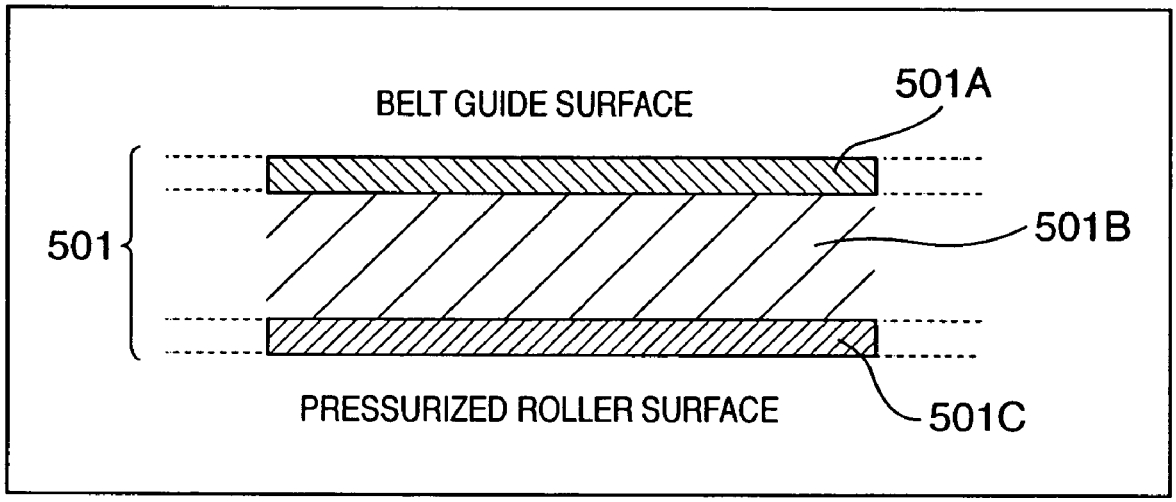
FIG. 8 is a view showing the layer arrangement of a fusing belt in the embodiment.

FIG. 8 is a view showing the layer arrangement of the fusing belt 501. As shown in FIG. 8, the fusing belt 501 has a composite structure of a heating layer 501A which is formed from an electromagnetic induction heating metal belt or the like and serves as a base layer, an elastic layer 501B stacked on the outer surface of the heating layer 501A, and a release layer 501C stacked on the outer surface of the elastic layer 501B. Primer layers may be provided between the respective layers to provide adhesion between the heating layer 501A and the elastic layer 501B and between the elastic layer 501B and the release layer 501C. In the fusing belt 501 having an almost cylindrical shape, the heating layer 501A is located on the inner surface side, and the release layer 501C is located on the outer surface side. As described above, when an alternating magnetic flux acts on the heating layer 501A, an overcurrent is generated in the heating layer 501A to generate heat in the heating layer 501A. This heat heats the fusing belt 501 through the elastic layer 501B and release layer 501C, and heats a printing material P as a material to be heated which is made to pass through the fusing nip portion N, thereby heating/fusing toner images.

The structure of the fusing device 23 in this embodiment has been roughly described above, and its operation will be roughly described below. As the pressurized roller 530 is rotated/driven, the cylindrical fusing belt 501 circumferentially rotates around the belt guide member 516*a*. The excitation circuit then supplies power to the exciting coil 506 to perform electromagnetic induction heating with respect to the fusing belt 501 in the above manner. This raises the temperature of the fusing nip portion N to a predetermined temperature, thereby establishing a temperature-controlled state. In this state, a transfer sheet on which an unfused toner image t is formed and which is conveyed by the convey belt 20 in FIG. 1 is introduced between the fusing belt 501 at the fusing nip portion N and the pressurized roller 530 with the image surface facing up, i.e., facing the fusing belt surface. As a consequence, the image surface comes into tight contact with the outer surface of the fusing belt 501 at the fusing nip portion N and is conveyed through the fusing nip portion N in a clamped state, together with the fusing belt 501. In the process of conveying the transfer sheet through the fusing nip portion N in the clamped state together with the fusing belt 501, the unfused toner image t is heated/fused on the transfer sheet by the fusing belt 501 heated by electromagnetic induction heating. When the transfer sheet passes through the fusing nip portion N, the sheet is separated from the outer surface of the fusing belt 501 during rotation and conveyed and discharged.

In this embodiment, since toner containing a low-softening substance is used as toner t, the fusing device 23 is not provided with any oil applying mechanism for the prevention of offsets. If, however, toner containing no low-softening substance is used, an oil applying mechanism may be provided. Furthermore, even if toner containing a low-softening substance is used, oil application and cooling separation may be done.

<Arrangement of Power Supply Control System>

Figure 3:
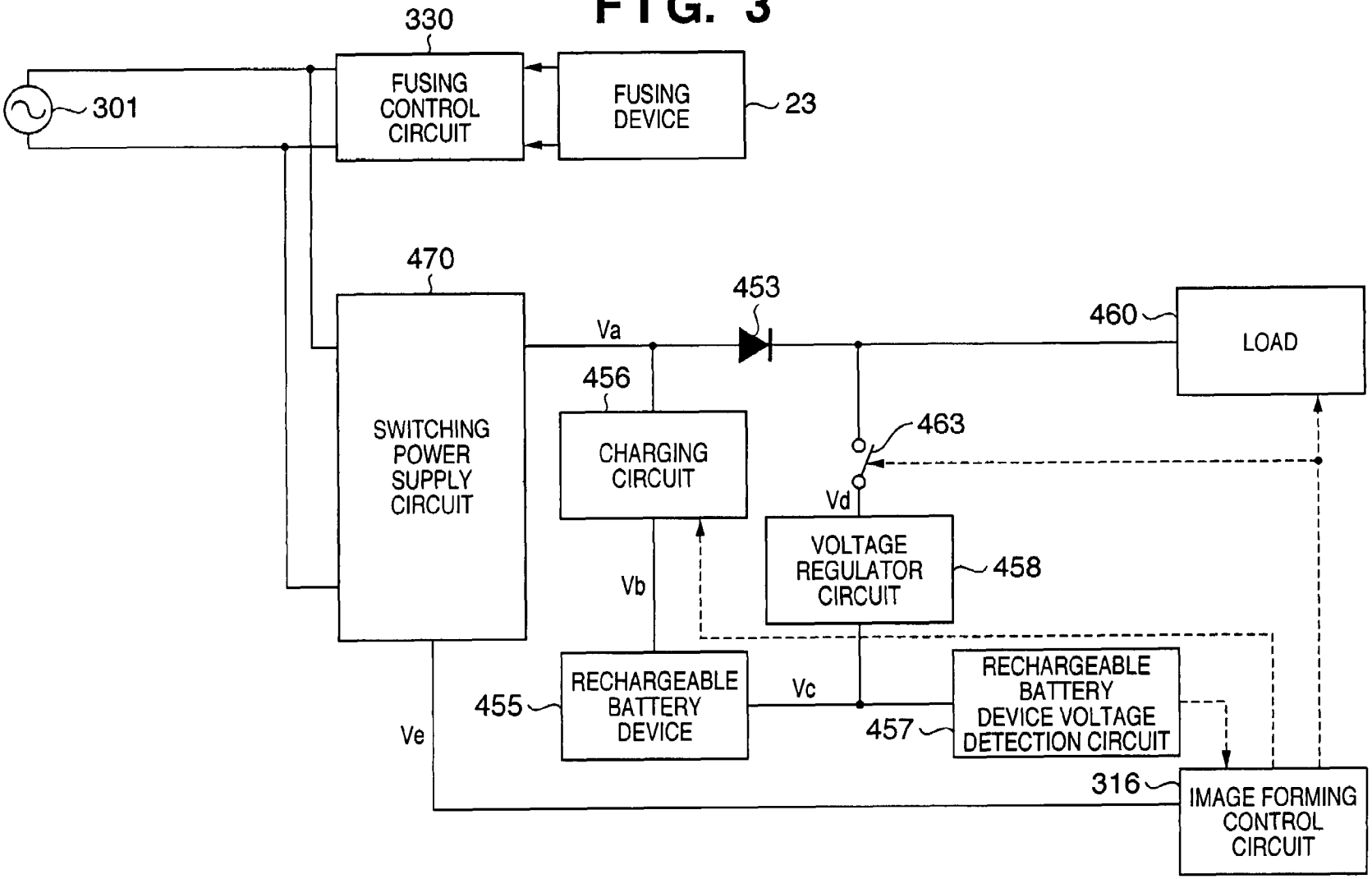
FIG. 3 is a block diagram showing the arrangement of a power supply control system of a laser beam printer according to a first embodiment.

FIG. 3 is a view showing the arrangement of the power supply control system of the laser beam printer 100 according to this embodiment. An AC voltage from a commercial power supply 301 is applied to a switching power supply circuit 470 and a fusing control circuit 330 functioning as an excitation circuit (induction heating control unit) which supplies an alternating current to the fusing device 23. The switching power supply circuit 470 applies an AC voltage from the commercial power supply 301 upon stepping-down the voltage into a DC voltage of 24 V or the like which is used in the image forming unit or the like. An output voltage Ve from the switching power supply circuit 470 is applied to an image forming control circuit 316 which control image forming operation. An output voltage Va from the switching power supply circuit 470 is applied to a load 460. In this case, the load 460 is a load in the image forming unit other than the exciting coil 506 as a heating element, and includes, for example, four DC brushless motors (not shown) which drive four photoconductive drums 18*a* to 18*d*, respectively, and one DC brushless motor (not shown) which drives the convey belt 20. A total of these five DC brushless motors are controlled to be simultaneously rotated/stopped by the image forming control circuit 316 so as to prevent the wear of the surface of the convey belt 20 which is in contact with the photoconductive drum 18*a-d*. It is known that the photoconductive drums 18*a* to 18*d* and the like to which these motors supply driving forces vary in torque as the laser beam printer 100 is used. Therefore, the torques of the DC brushless motors and power to be supplied must be designed in consideration of increases in torque after the printer is used for a certain period of time.

Reference numeral 456 denotes a charging circuit which receives the voltage Va applied from the switching power supply circuit 470, and applies a predetermined voltage Vb (Vb≈Va in this case) to a rechargeable battery device 455 comprised of, for example, a plurality of electric double-layer capacitors to charge the rechargeable battery device 455 to a predetermined voltage Vc (≈Vb). An electric double-layer capacitor is an element which has a large capacitance of several F or more, is higher in recharging efficiency than a secondary battery, and has a long service life. This element therefore has recently received a great deal of attention in many fields.

The predetermined voltage Vc of the rechargeable battery device 455 is detected by a rechargeable battery device voltage detection circuit 457. This detection result is transmitted as, for example, an analog signal, to the A/D port of the CPU in the image forming control circuit 316. The image forming control circuit 316 determines in accordance with the detection result obtained by the rechargeable battery device voltage detection circuit 457 whether or not the charging circuit 456 needs to be recharged.

A voltage regulator circuit 458 is, for example, a switching step-up converter, which steps up the predetermined voltage Vc of the rechargeable battery device 455 to a voltage Vd (Vd≈Va−Vf, for Vd>Vc, and Vf=forward voltage of diode 453: about 0.6 V) which is required to drive the load 460, and applies the voltage Vd to the load 460 through a switch 463. This voltage is used to drive a motor or the like. The switch 463 functions as a selection means for selecting the commercial power supply 301 or rechargeable battery device 455 as a source for supplying power to the load 460. More specifically, when the switch 463 is turned off, the commercial power supply 301 becomes a source for supplying power to the load 460. In contrast, when the switch 463 is turned on, the rechargeable battery device 455 becomes a source for supplying power to the load 460. As the switch 463, a semiconductor switch such as an FET is preferably used in consideration of ON/OFF durability. If, however, no problem arises in terms of service life, e.g., ON/OFF count, a mechanical switch such as a relay may be used. In addition, the diode 453 prevents the output voltage Va from the switching power supply circuit 470 from being supplied to the load 460 while the rechargeable battery device 455 is applying the voltage Vd through the voltage regulator circuit 458.

<Arrangement of Fusing Control Circuit 330>

First of all, see FIG. 4 showing the arrangement of the fusing device 23. In this embodiment, as shown in FIG. 4, a thermoswitch 502 serving as a temperature detection element is placed, in a non-contact state, at a position to face the heating region Sa (corresponding to the heating region H in FIG. 7) of the fusing belt 501. The fusing control circuit 330 controls the supply of power to the exciting coil 506 in accordance with the operation of the thermoswitch 502 in order to interrupt the supply of power to the exciting coil 506 at the time of runaway. In this case, the OFF operating temperature of the thermoswitch 502 is set to 220° C. In addition, the distance between the thermoswitch 502 and the fusing belt 501 is set to about 2 mm. This makes it possible to prevent the thermoswitch 502 from contacting and damaging the fusing belt 501, thereby preventing a deterioration in fused image quality due to the long use of the fusing device 23.

Note that as this temperature detection element, a temperature fuse may be used instead of the thermoswitch 502.

Figure 9:
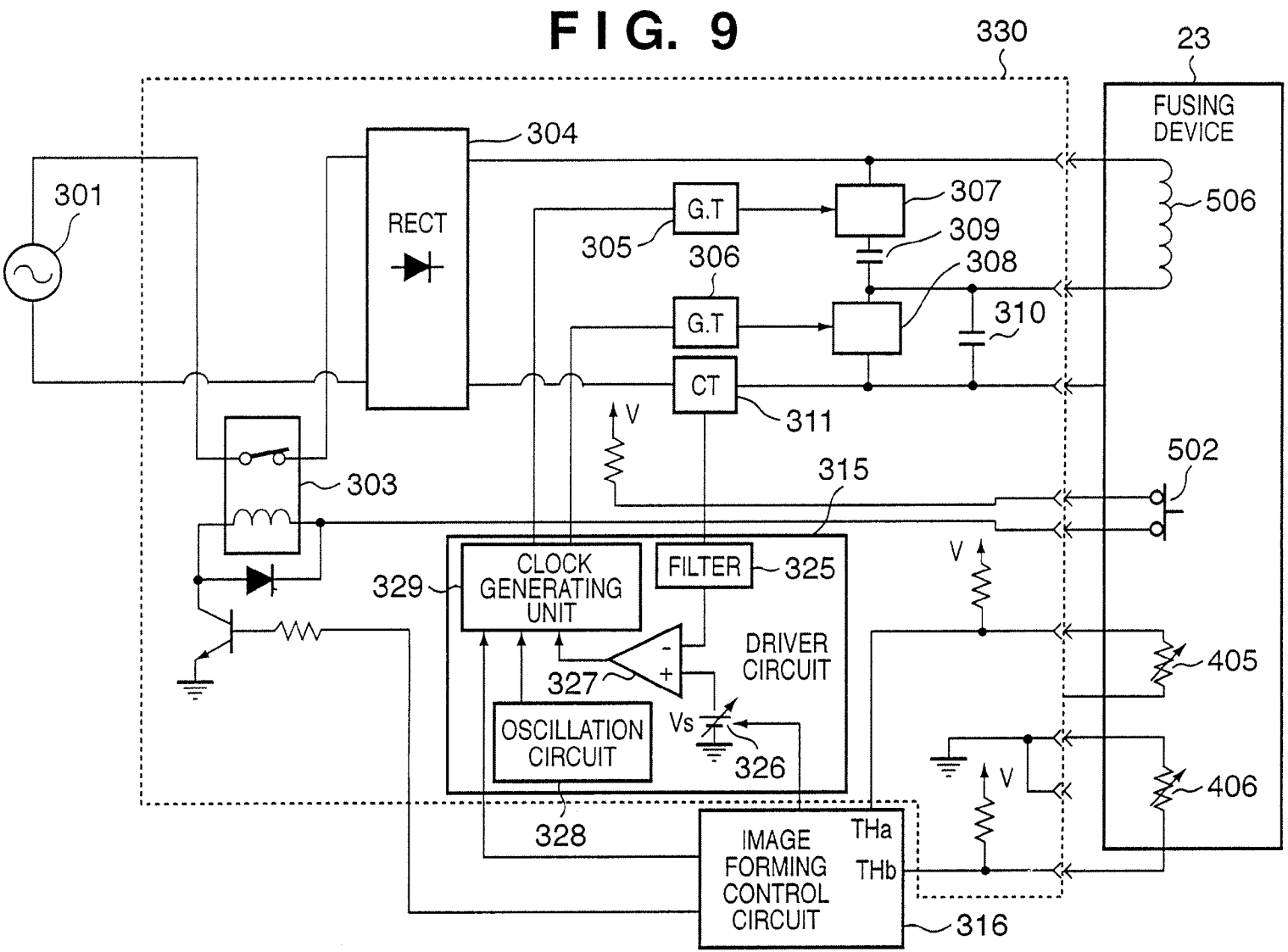
FIG. 9 is a block diagram showing the arrangement of a fusing control circuit in the embodiment.

FIG. 9 is a block diagram showing the arrangement of the fusing control circuit 330 in this embodiment. The fusing control circuit 330 is arranged such that the thermoswitch 502 is connected in series with a +24-V DC power supply and relay switch 303, and when the thermoswitch 502 is turned off, the supply of power to the relay switch 303 is interrupted, and the relay switch 303 operates to interrupt the supply of power to the fusing control circuit 330, thereby interrupting the supply of power to the exciting coil 506.

The arrangement of the fusing control circuit 330 shown in FIG. 9 will be described in detail, together with the operation of the fusing control circuit 330. A rectifying circuit 304 is comprised of a bridge rectifying circuit which performs full-wave rectification from an AC input and a capacitor which performs high-frequency filtering. Each of first and second switch elements 308 and 307 switches currents. A current transformer (CT) 311 is a transformer which detects currents switched by the first and second switch elements 308 and 307.

As described above, the fusing device 23 is provided with the exciting coil 506, the temperature detection thermistors (temperature sensors) 405 and 406, and the thermoswitch 502 which detects an excessive temperature rise.

A driver circuit 315 which drives the first and second switch elements 308 and 307 through gate transformers 306 and 305 is comprised of a filter 325 which filters an output voltage from the current transformer 311, an oscillation circuit 328, a comparator 327, a reference voltage Vs 326, and a clock generating unit 329. The clock generating unit 329 generates a clock for temperature control. In addition, when the temperature detected at the nip portion between the fusing belt 501 and the pressurized roller 530 exceeds a specified temperature, the clock generating unit 329 performs control to stop the supply of driving pulses to the exciting coil 506 in accordance with a signal from the image forming control circuit 316 and stop the supply of power to the fusing device 23.

The image forming control circuit 316 controls the controlled variable while comparing with a target temperature on the basis of the temperature detection value obtained by the thermistor 406 provided in the fusing device 23. The driver circuit 315 receives a control signal from the image forming control circuit 316, and generates switching clocks to be supplied to the gate transformers 305 and 306, thereby performing control suitable for the control form of a high-frequency inverter device.

As the first and second switch elements 308 and 307, power switch elements are optimally used, and are comprised of FETs or IGBTs (+reverse conducting diodes). As the first and second switch elements 308 and 307, high breakdown voltage, large-current switching elements which have small losses in a steady state and small switching losses are preferably used to control resonant currents.

When AC input power is received from the commercial power supply 301, and the AC power is applied to the rectifying circuit 304 through the relay switch 303, a pulsating DC voltage is generated by the full-wave rectifying diode of the rectifying circuit 304. The second switch element 307 then drives the gate control transformer 305 so as to perform switching, thereby applying an AC pulse voltage to the resonant circuit comprised of the exciting coil 506 and a resonant capacitor 309. As a consequence, when the first switch element 308 is turned on, a pulsating DC voltage is applied to the exciting coil 506, and a current determined by the inductance and resistance of the exciting coil 506 begins to flow. When the first switch element 308 is turned off in accordance with a gate signal, since the exciting coil 506 tries to keep supplying a current, a high voltage called a flyback voltage is generated across the exciting coil 506 in accordance with the sharpness or quality factor Q of the resonant circuit which is determined by the resonant capacitor 309. This voltage oscillates about the power supply voltage, and converges to the power supply voltage if the switch is kept off.

During a period in which the ringing of the flyback voltage is large and the voltage of the coil-side terminal of the first switch element 308 becomes negative, the reverse conducting diode is turned off, and a current flows into the exciting coil 506. During this period, the contact point between the exciting coil 506 and the first switch element 308 is clamped to 0 V. It is generally known that if the first switch element 308 is turned on in such a period, the first switch element 308 can be turned on without application of voltage. This operation is called ZVS (Zero Voltage Switching). This driving method can minimize the loss accompanying the switching operation of the first switch element 308, thereby realizing high-efficiency, low-noise switching.

Figure 10:
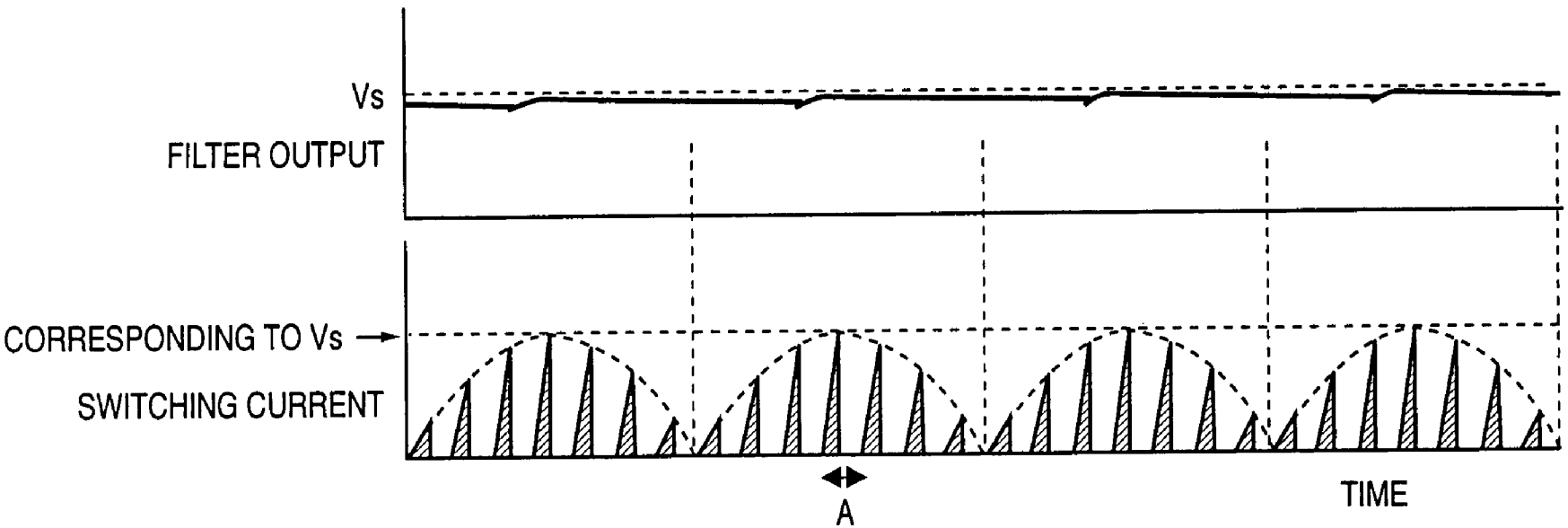
FIG. 10 is a timing chart showing a switching current in the fusing control circuit in the embodiment.

The detection of a current in the exciting coil 506 using the current transformer 311 in FIG. 9 will be described next. FIG. 10 shows an example of a detected waveform. The current transformer 311 is designed to detect a current flowing from the emitter (the drain in the case of an FET) of the first switch element 308 to the negative terminal of the rectifying circuit 304 and the filter capacitor (not shown) connected to the output of the rectifying circuit 304. A power-side current is supplied to the 1-turn side of the current transformer 311 having a winding ratio of 1:n, and is detected as voltage information by a detection resistor provided on the n-turn side. As shown in FIG. 10, the switching current waveform exhibits a sawtooth shape corresponding to a switching frequency (20 kHz to 500 kHz). The envelope of the current peak value of this switching current is the shape obtained by full-wave rectifying a sine wave having a commercial frequency (e.g., 50 Hz). The detection current detected by the current transformer 311 is peak-held/rectified by the filter 325. The current detection (voltage) value filtered by the filter 325 is transmitted to the negative input terminal of the comparator 327, and the reference voltage Vs 326 is transmitted to the positive input terminal of the comparator 327. The comparator 327 then compares the values. If the current detection value is larger than the reference voltage Vs 326, the comparator 327 outputs a low-level signal to the clock generating unit 329 to prevent a switching (peak) current equal to or larger than a current corresponding to the reference voltage Vs 326 from flowing. Therefore, the ON time of clocks supplied from the clock generating unit 329 to the gate transformers 305 and 306 is limited pulse by pulse, thereby limiting the switching (peak) current.

Figure 11:
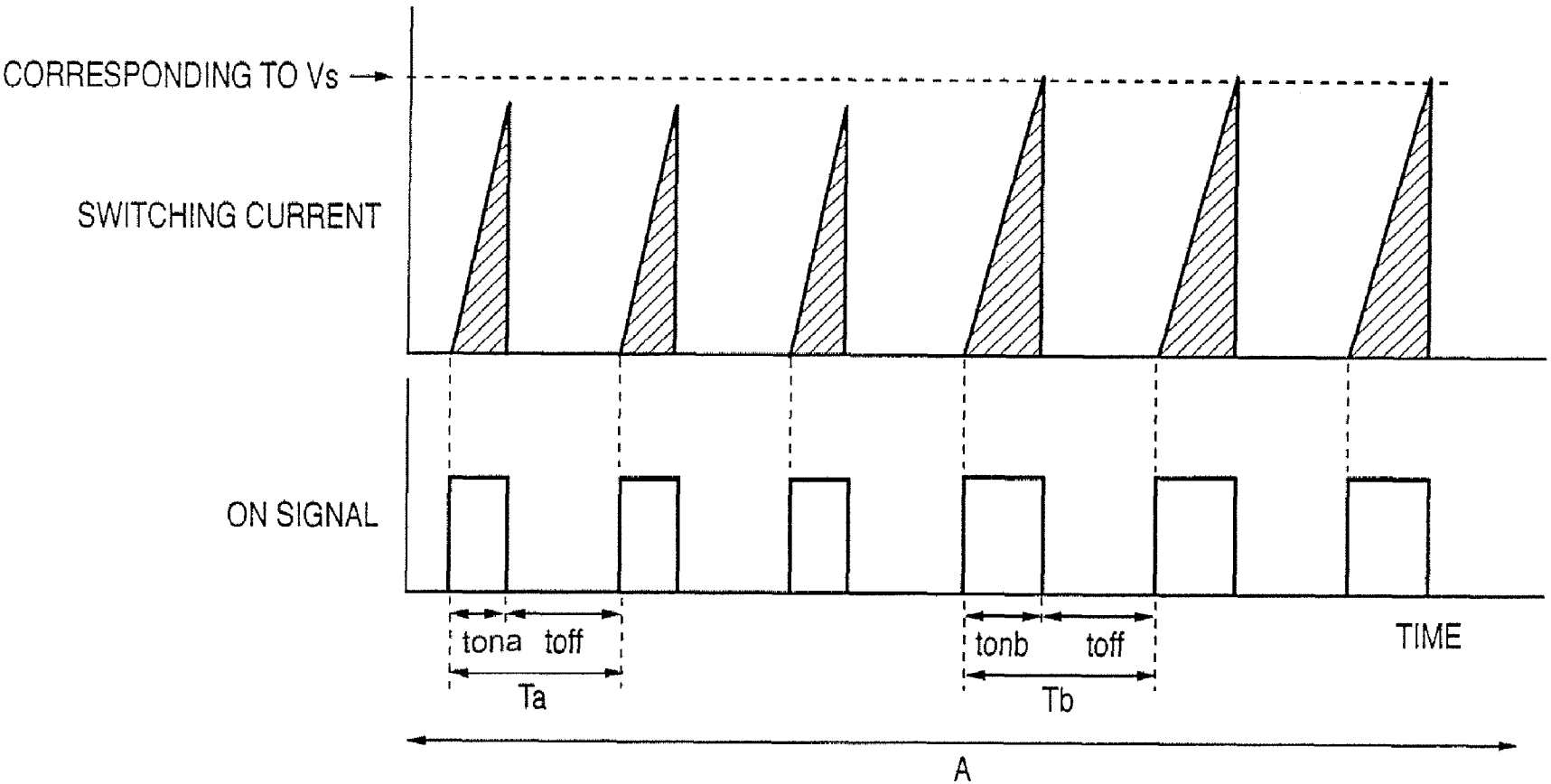
FIG. 11 is a timing chart for explaining limiter operation for limiting the maximum power supplied to the fusing device in the embodiment.

FIG. 11 shows a time range A in FIG. 10 in an enlarged form. In this case, when the ON time of a pulse which drives the first switch element 308 is tona, the peak value of the detection voltage of a switching current flowing in the element does not reach the predetermined voltage Vs. In contrast, when, for example, the power supplied to the fusing device 23 increases and the ON time becomes tonb, the peak value of the detection voltage of a switching current flowing in the element reaches the predetermined voltage Vs. For this reason, the clock generating unit 329 limits the ON time from becoming longer than tonb in accordance with an output from the comparator 327. More specifically, the clock generating unit 329 is designed to perform a limiter operation to limit the maximum power supplied to the fusing device 23 by suppressing the peak value of a switching current to a predetermined value. Such protection is provided when an abnormal current is detected, e.g., when a larger current flows.

The voltage dependence of the maximum power (initial power) supplied to the fusing device 23 will be described next. In a system in which no current control is performed, an output power varies by the square of an AC line voltage. In contrast to this, in this arrangement designed to limit the maximum power by current detection, an output voltage can be made to linearly depend on an input voltage.

Figure 12:
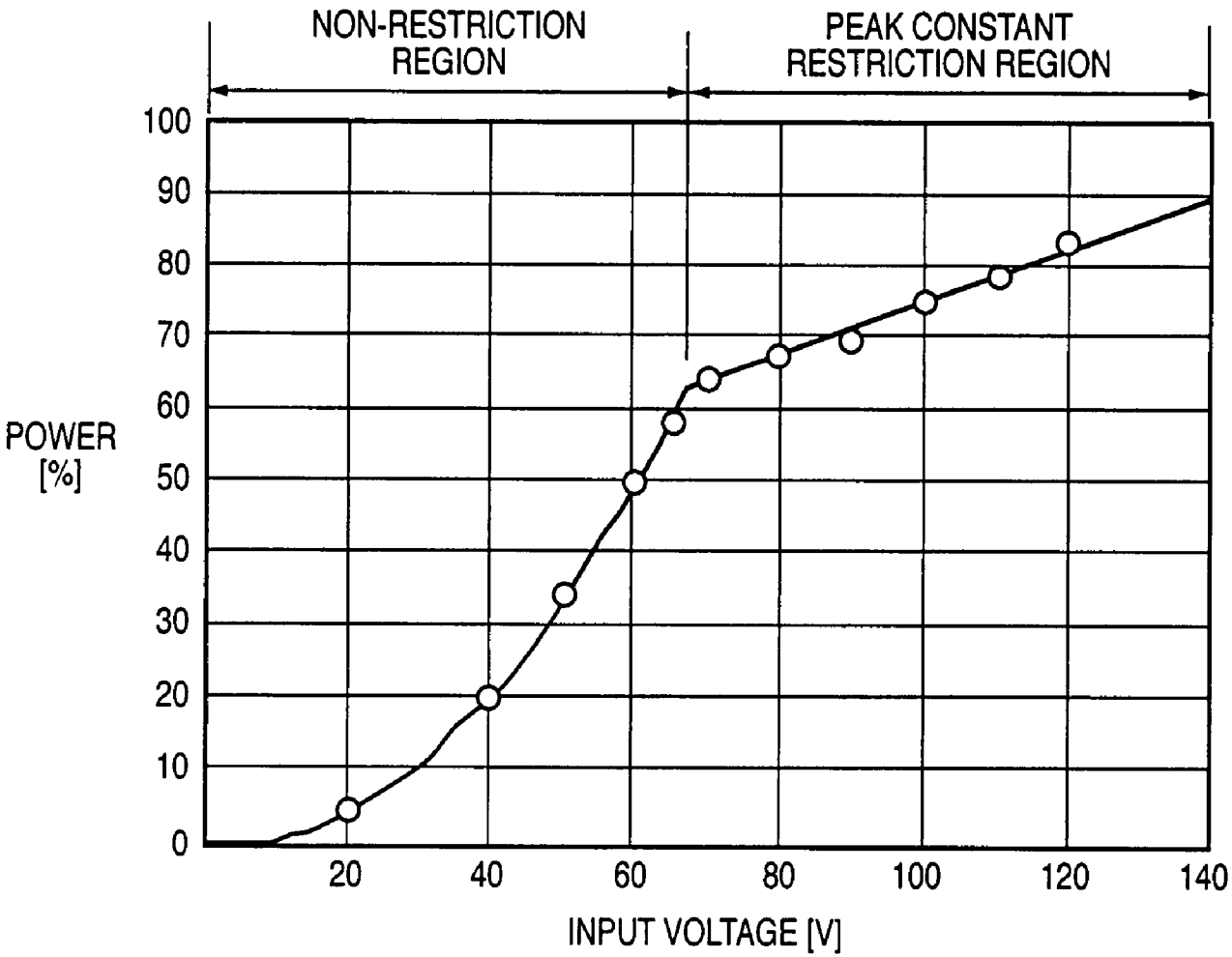
FIG. 12 is a graph for explaining the voltage dependence of the maximum power supplied to the fusing device in the embodiment.

FIG. 12 shows the results obtained by forming such a circuit and conducting experiments. The "non-restriction region" in FIG. 12 indicates the experimental result obtained without current control, in which the power changes by the square of the input voltage. This indicates that the power dependence of the power supply voltage is large. In contrast, the "peak constant restriction region" indicates the experimental result obtained when control is made to keep a detected peak current constant in an input voltage range including the voltage used by the laser beam printer 100. As shown in FIG. 12, the power varies little with the power supply voltage. That is, the maximum output voltage of the power control circuit is controlled on the basis of a detected peak current to control the maximum value of the power control width (maximum supply power) on the basis of an AC line current detection result, thereby controlling the maximum power that can be supplied to make it difficult to depend on an AC line voltage.

Since power is controlled by detecting a current, the time during which a current flows in the exciting coil 506 of the fusing device 23, i.e., the maximum value of the time during which the first switch element 308 is ON, is determined by a current flowing in the AC line and the power that can be supplied, and a control signal from the image forming control circuit 316 is made to fall within the range of that time. In addition, this circuit may also be designed to specify the minimum time.

<Power Control Operation>

Power control in this embodiment will be described below.

An image forming apparatus generally consumes a large amount of power. Most of the power consumption is attributed to the fusing device. In general, therefore, power control is performed such that if a standby state with respect to a print request continues for a predetermined period of time or more, the operation mode shifts to a so-called energy saving mode or sleep mode in which a standby state is continued while the power supplied to the fusing device is reduced. The laser beam printer 100 in this embodiment also has this energy saving mode as an operation mode. Obviously, in the energy saving mode, the temperature of the fusing device decreases. Consequently, the fusing device is cooled at the time of returning from the energy saving mode (shifting to the normal mode) as well as at the time of turning on the power switch. As described above, it is a challenge to shorten the time required for the temperature of the fusing device in a cooled state to reach a temperature in the standby state (warm-up time). This challenge can be solved by power control in this embodiment which will be described below.

When the energy saving mode is set or the rechargeable battery device 455 needs not supply any power, the image forming control circuit 316 turns off the switch 463 and operates the charging circuit 456 to charge the rechargeable battery device 455 in advance.

When the fusing device 23 is to be used at turn-on, upon returning from the energy saving mode, upon reception of a print request, at the start of an image forming operation, or the like, the image forming control circuit 316 turns on the switch 463 to drive the load 460 using power from the rechargeable battery device 455. The supply of power from the rechargeable battery device 455 saves power from the commercial power supply 301 by the amount of power consumed by the load 460. Consequently, this produces a surplus capacity for the maximum power specified by the maximum current of the commercial power supply 301.

Assume that the temperature of the fusing device 23 is raised, a current of 11 A flows in the primary side (AC side) of the fusing control circuit 330, and a current of 3 A flows in the primary side (AC side) of the switching power supply circuit 470. In this case, expecting that variations in power or the like dependent on the input voltage to the fusing control circuit 330 are about 1 A, the total power becomes 15 A (=11 A+3 A+1 A) (assuming that power factors cos θ of the fusing control circuit 330 and switching power supply circuit 470 are both 1). That is, the total power falls within the maximum current, 15 A, of the commercial power supply 301, i.e., an allowable power of 1,500 W (=100 V×15 A).

The allowable power of 1,500 W referred in this case is an example in Japan. It is therefore necessary to design a control circuit so as to comply with the allowable power specified by a safety standard or the like in each country to which the image forming apparatus is actually shipped out. For example, for an image forming apparatus destined for the U.S., power design needs to be made to comply with the input current value specified by the UL1950 1.6.1 safety standard.

Assume that under such a condition, as power has been supplied from the rechargeable battery device 455 to the load 460, the current value on the primary side (AC side) of the switching power supply circuit 470 has decreased by 2 A. In this case, while the load 460 is driven by power from the rechargeable battery device 455, power corresponding to 2 A (200 W=100 V×2 A) from the commercial power supply 301 is saved. This produces a surplus capacity for the maximum supply current of the commercial power supply 301. The image forming control circuit 316 therefore increases the reference voltage Vs 326 in the driver circuit 315 of the fusing control circuit 330 by an amount corresponding to 2 A to increase the limit value of power supplied to the fusing device 23. Consequently, a current of 13 A flows on the primary side (AC side) of the fusing control circuit 330, and a current of 1 A flows on the primary side (AC side) of the switching power supply circuit 470. The variations remain about 1 A. The total current is 15 A (=13 A+1 A+1 A), which falls within the maximum allowable power of the commercial power supply 301, as in the above case. Obviously, actual design must be done in consideration of design variations so as not to exceed the maximum current that can be supplied from the commercial power supply 301.

By adjusting the reference voltage Vs 326 in accordance with the supply state of power from the rechargeable battery device 455 to the load 460, i.e., the state of the switch 463 serving as a selection means, in this manner, the limit level of power supplied to the fusing device 23 can be adjusted.

Figure 27:
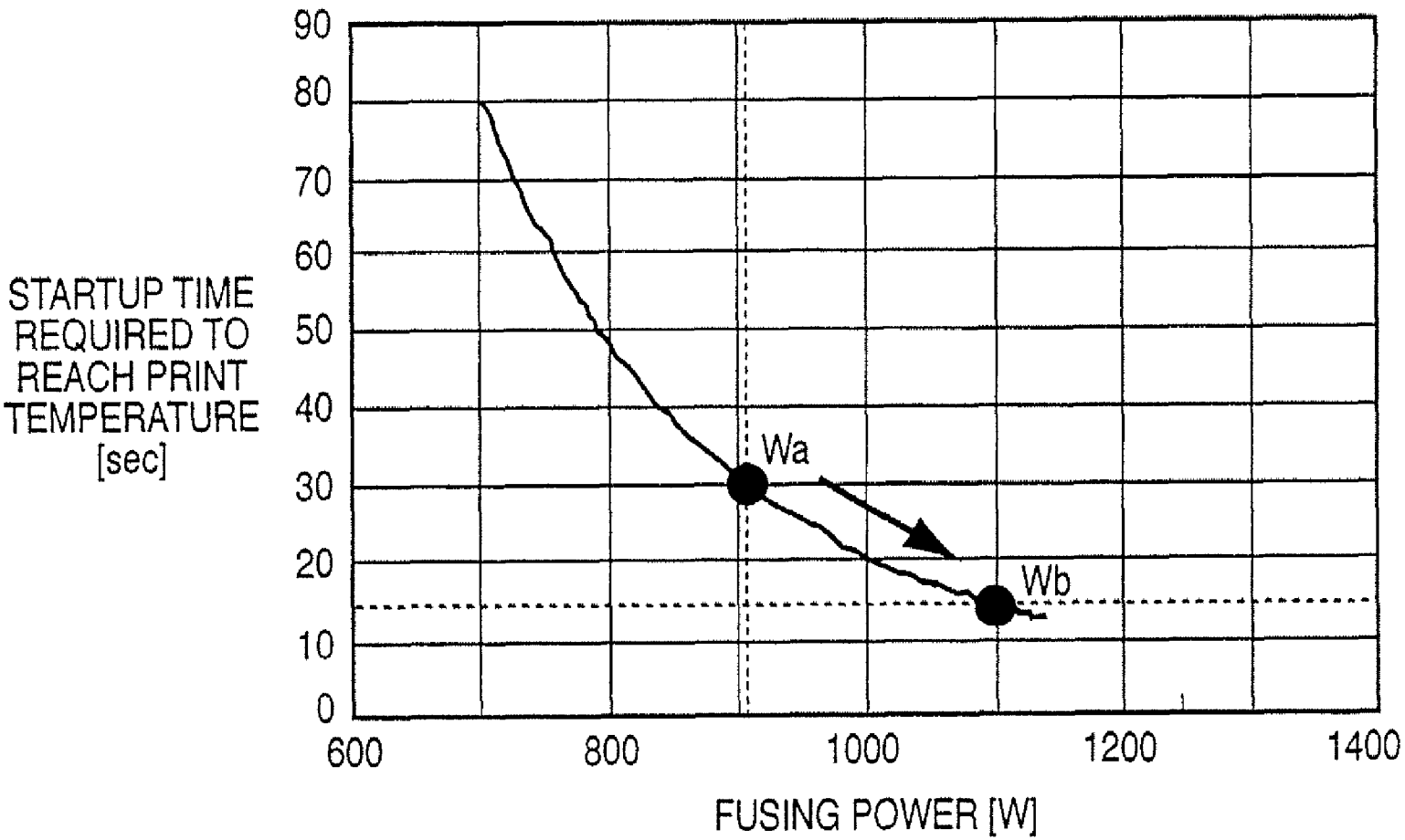
FIG. 27 PRIOR ART
FIG. 27 is a graph showing the relationship between fusing power and print temperature in a fusing device based on a conventional electromagnetic induction heating system.

If a power of about 200 W (=100 V×2 A) can be supplied to the fusing device 23 by using the rechargeable battery device 455 in the above manner to raise the temperature of the fusing device 23, there is a possibility that on-demand fusing can be implemented. Referring to FIG. 27, when a power of 200 W is supplied to the fusing device 23 by using the rechargeable battery device 455 in the above manner, the time required to reach the print temperature in FIG. 27 is reduced from 30 sec (point Wa) to 15 sec (point Wb). That is, the temperature rise time of the fusing device 23 can be shortened.

Power control operation in this embodiment has been roughly described above, and power control to be done in consideration of the charged state of the rechargeable battery device 455 and/or the temperature of the fusing device 23 will be described below.

Figure 23:
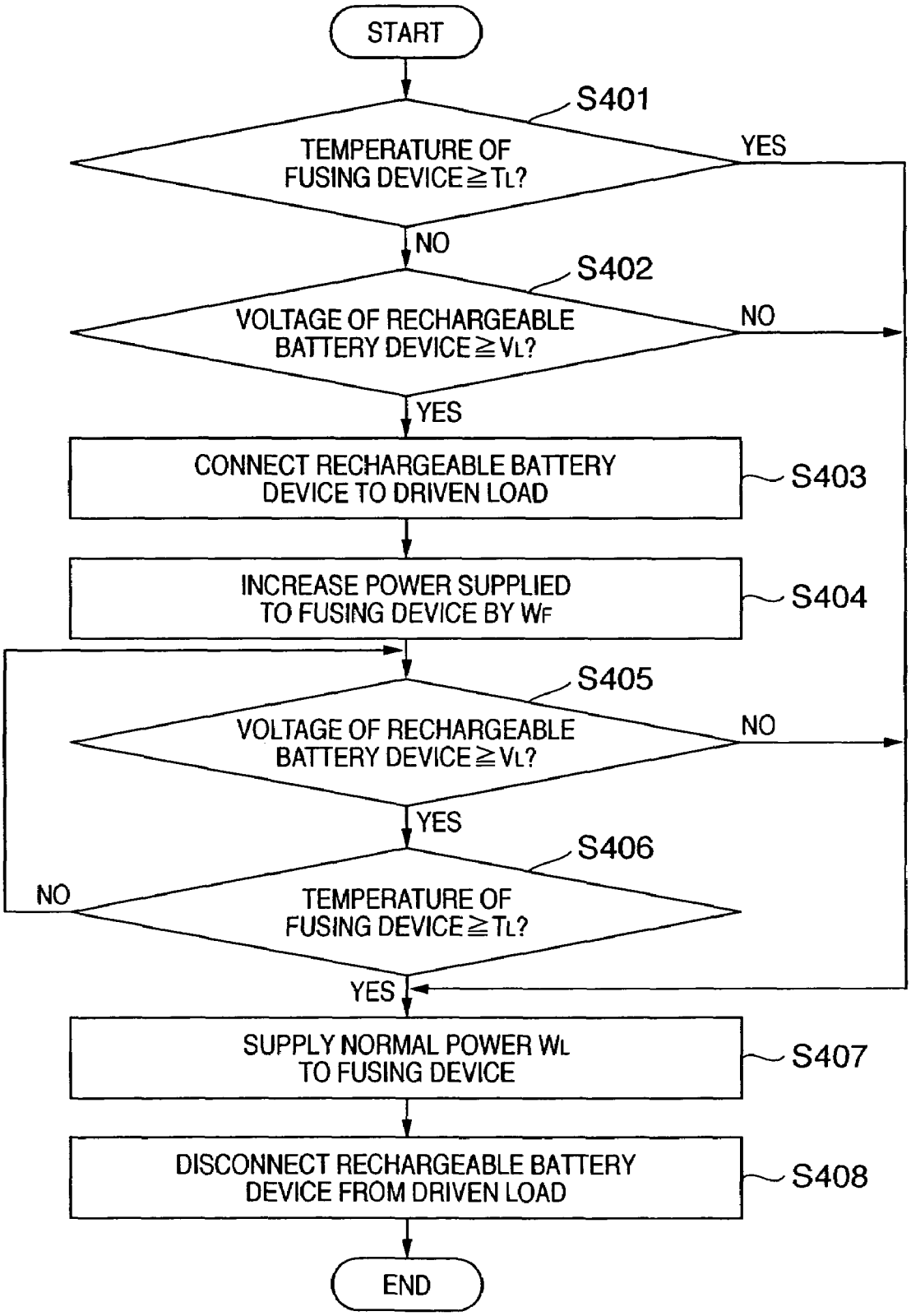
FIG. 23 is a flowchart showing power control operation to be done in consideration of the charged state of a rechargeable battery device and/or the temperature of the fusing device in the first embodiment.

FIG. 23 is a flowchart showing power control operation performed by the image forming control circuit 316 in consideration of the charged state of the rechargeable battery device 455 and/or the temperature of the fusing device 23. This processing is started at turn-on or upon returning from the energy saving mode.

First of all, in step S401, the image forming control circuit 316 receives the temperature detection value obtained by the thermistor 406 provided in the fusing device 23 (see FIG. 9), and determines whether or not the temperature detection value is equal to or more than a lower limit temperature $T_L$ at which fusing can be done. If the temperature of the fusing device 23 has already been equal to or more than the lower limit temperature $T_L$ at which fusing can be done, since there is no need to quickly start the fusing device 23 by supplying power from the rechargeable battery device 455, the flow advances to step S407 to supply normal power $W_L$ from the commercial power supply 301 by maintaining the OFF state of the switch 463. Step S408 following step S407 is the step of disconnecting the rechargeable battery device 455 from the load 460. In this case, however, since the switch 463 has been maintained in the OFF state, this processing is terminated in this state.

If it is determined in step S401 that the temperature detection value obtained by the thermistor 406 (i.e., the temperature of the fusing device 23) is less than $T_L$, the flow advances to step S402 to determine whether or not the charged voltage Vc of the rechargeable battery device 455 which is detected by the rechargeable battery device voltage detection circuit 457 is equal to or less than a lower limit voltage $V_L$ which can be stepped up by the voltage regulator circuit 458 to the voltage Vd required to drive the load 460. If the charged voltage Vc of the rechargeable battery device 455 is less than $V_L$, it is determined that the rechargeable battery device 455 is in an undercharged state, and the flow advances to step S407 as in the case wherein it is determined in step S401 that the temperature of the fusing device 23 has already been equal to or more than the lower limit temperature $T_L$ at which fusing can be done. This is because, even if power is supplied from the rechargeable battery device 455 by turning on the switch 463 in this undercharged state, it does not contribute to quick startup of the fusing device 23 and may work against the startup operation.

If it is determined in step S402 that the charged voltage Vc is equal to or more than $V_L$, the flow advances to step S403 to turn on the switch 463 to connect the rechargeable battery device 455 to the load 460. The load 460 is therefore driven by power from the rechargeable battery device 455. This produces a surplus capacity for the maximum power specified by the maximum current of the commercial power supply 301, and the surplus capacity can be provided for the fusing device 23, as described above.

In this embodiment, in step S404, the power supplied to the fusing device 23 is increased by a power $W_F$ corresponding to the surplus capacity for the maximum power of the commercial power supply 301. More specifically, this operation can be realized by, for example, increasing the reference voltage Vs 326 (see FIG. 9) in the driver circuit 315 of the fusing control circuit 330 by an amount corresponding to the power $W_F$ so as to increase the limit value of power supplied to the fusing device 23. As a consequence, the power supplied to the fusing device 23 becomes a power of $W_L+W_F$ from the commercial power supply 301. Note that the power ($W_L+W_F$) supplied to the fusing device 23 is preferably set in accordance with the minimum voltage within the voltage range of the commercial power supply 301 (e.g., if the voltage range is 100 to 127 V, the minimum voltage is 100 V, which is the lower limit voltage in the voltage range).

While power is supplied from the rechargeable battery device 455 to the load 460 in steps S403 and S404, it is monitored in steps S405 and S406 whether or not the charged voltage Vc of the rechargeable battery device 455 which is detected by the rechargeable battery device voltage detection circuit 457 is maintained at the lower limit voltage $V_L$ which can be stepped up by the voltage regulator circuit 458 to the voltage Vd required to drive the load 460, and whether or not the temperature detection value obtained by the thermistor 406 has become equal to or more than the lower limit temperature $T_L$ at which fusing can be done by the fusing device 23.

If the charged voltage Vc of the rechargeable battery device 455 becomes lower than $V_L$ (NO in step S405) or the temperature detection value obtained by the thermistor 406 (i.e., the temperature of the fusing device 23) becomes equal to or higher than $T_L$ (YES in step S406), the flow advances to step S407 to return the power supplied to the fusing device 23 to the normal power $W_L$. More specifically, this operation can be realized by, for example, decreasing the reference voltage Vs 326 (see FIG. 9) in the driver circuit 315 of the fusing control circuit 330 by an amount corresponding to the power $W_F$, by which the supply power is increased in step S404, to decrease the limit value of power supplied to the fusing device 23.

In step S408, the switch 463 is turned off to disconnect the rechargeable battery device 455 from the load 460. This processing is then terminated.

Figure 26:
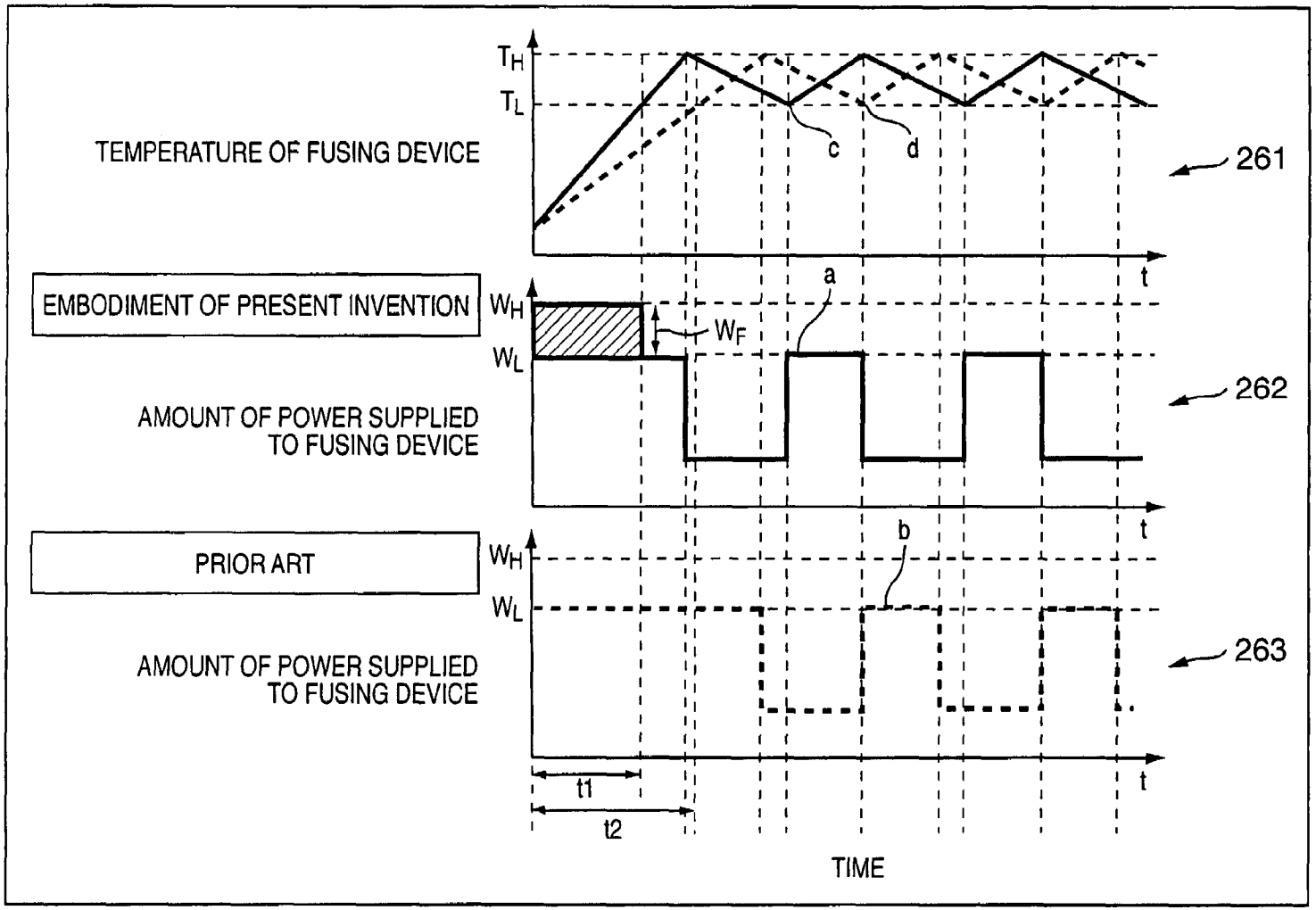
FIG. 26 is a timing chart for explaining the effects of power control operation in the present invention.

The effect of the above power control based on the consideration of the charged state of the rechargeable battery device 455 and/or the temperature of the fusing device 23 will be described. FIG. 26 shows changes in power supplied to the fusing device as a function of time in this embodiment and in the prior art using no rechargeable battery device. Referring to FIG. 26, a solid line a in a graph 262 indicates the amount of power supplied to the fusing device 23 in this embodiment, and a broken line b in a graph 263 indicates the amount of power supplied to the fusing device in the prior art using no rechargeable battery device. In addition, solid lines c and d in a graph 261 respectively indicate changes in the temperature of the fusing device in this embodiment and changes in the temperature of the fusing device in the prior art as a function of time in the process of supplying power to each fusing device.

As shown in FIG. 26, when the fusing device is to be started up from a temperature lower than the lower limit temperature $T_L$ at which fusing can be done, the conventional image forming apparatus requires a time $t_2$ to make the temperature of the fusing device reach $T_L$ by supplying only the normal power $W_L$ from the commercial power supply to the fusing device. The laser beam printer 100 of this embodiment, however, takes a time $t_1$ to make the temperature of the fusing device to reach $T_L$, which is shorter than $t_2$, since the amount of power supplied to the fusing device 23 is increased by $W_F$.

In power control based on the consideration of the charged state and/or the temperature of the fusing device, the condition for disconnecting the rechargeable battery device 455 from the load 460 is that the temperature of the fusing device 23 becomes higher than the lower limit temperature at which fusing can be done as in step S406. If, however, the relationship between the power supplied to the fusing device 23, temperature increases/decreases, and time is known in advance, a condition can be set on the basis of an elapsed time or the total amount of power supplied instead of the condition in step S406.

As described above, the rechargeable battery device 455 is provided in the laser beam printer 100, and power is supplied from the rechargeable battery device 455 to the load 460 such as a motor other than the fusing device 23. This makes it possible to increase the limit value of power supplied to the fusing device 23 by an amount corresponding to a surplus capacity during the supply of power from the rechargeable battery device 455. By effectively using this surplus power as startup power for the fusing device 23, the startup time of the fusing device 23 can be shortened. In addition, since the fusing device 23 need not incorporate a plurality of heat sources such as a main heater and sub-heater, the arrangement of the fusing device can be simplified. In addition, on-demand fusing can be implemented depending on the arrangement of the image forming apparatus or performance such as printing speed or the like.

The first embodiment of the present invention has been described above. Several other embodiments will be described below. The rough structure of an image forming apparatus, the arrangement of each component, and its operation in each of these embodiments are almost the same as those in the first embodiment, but exhibits a characteristic difference in the arrangement of the power supply control system from the first embodiment. The following embodiments will therefore be described with reference to the same drawings as those used to describe the first embodiment. In addition, with regard to new drawings, components common to the first embodiment are denoted by the same reference numerals as in the first embodiment, and a description thereof will be omitted. That is, components or operations in other embodiments which are different from those in the first embodiment will be described below.

Second Embodiment

Figure 13:
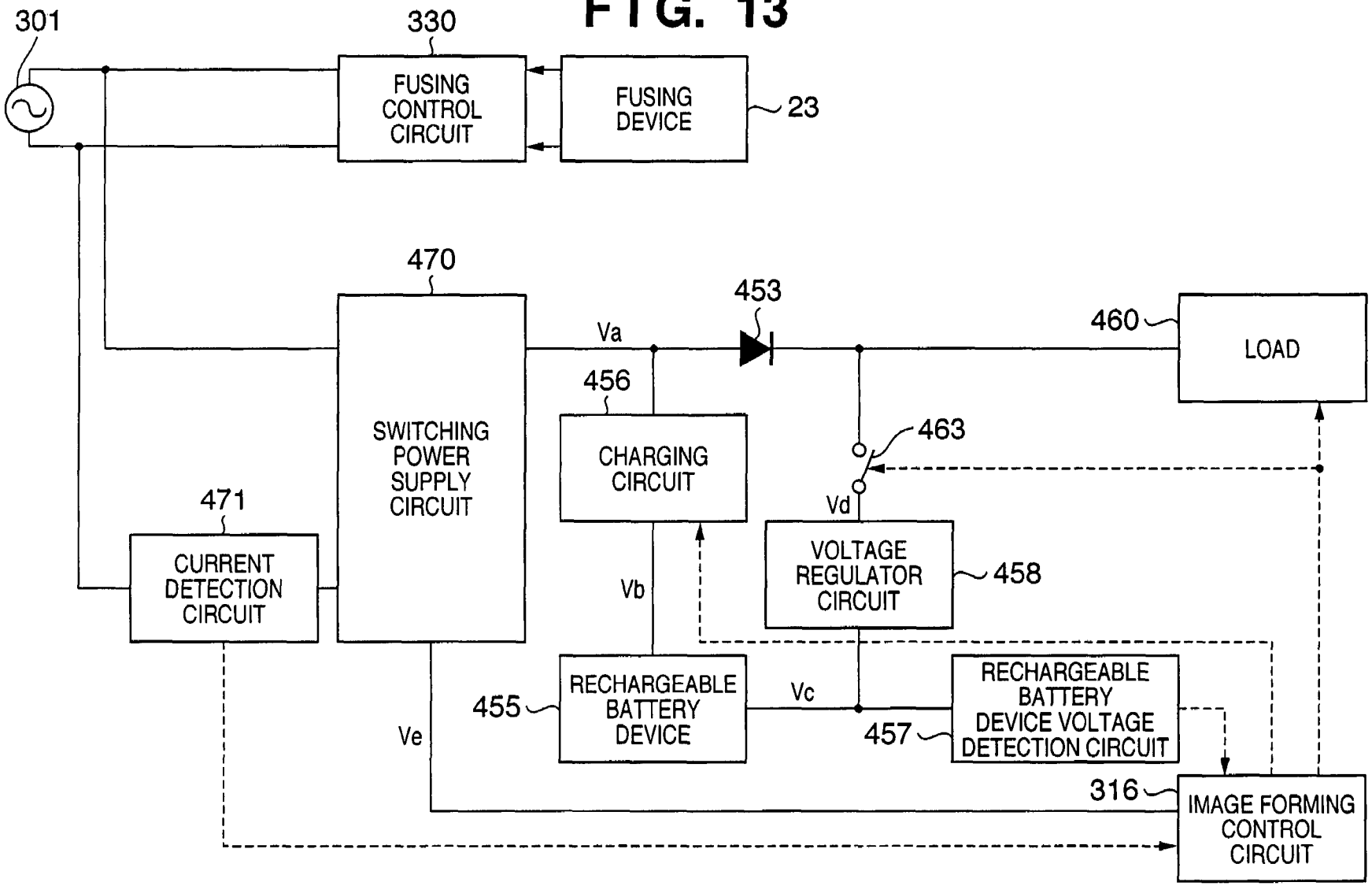
FIG. 13 is a block diagram showing the arrangement of a power supply control system of a laser beam printer according to a second embodiment.

FIG. 13 is a block diagram showing the arrangement of the power supply control system of a laser beam printer 100 in the second embodiment. This embodiment differs from the first embodiment (FIG. 3) in that a current detection circuit 471 is provided on the input side (primary side) of a switching power supply circuit 470. A current detected by the current detection circuit 471 is a physical quantity corresponding to the power supplied from a commercial power supply 301 to a load 460.

The current detection circuit 471 detects the root mean square value or mean value of input currents flowing in the switching power supply circuit 470, and transmits the detection value, as, for example, an analog signal, to the A/D port of a CPU (not shown) in an image forming control circuit 316.

The image forming control circuit 316 changes a reference voltage Vs 326 (FIG. 9) of a fusing control circuit 330 in accordance with the current detection result from the current detection circuit 471, thereby changing the power limit value into a predetermined value.

In the first embodiment, the degree of change in power limit value must be determined in advance in consideration of variations in the load 460, changes over time, and the like in addition to the maximum power consumed by the load 460. In general, however, the power consumption of the load seldom reaches this maximum power consumption that can be estimated. In image forming operations, the power consumption of the load is sufficiently lower than the estimated maximum power consumption. If there is a difference between the maximum power consumption and an actual power consumption, the difference in power can be regarded as surplus power. Therefore, while a switch 463 is closed to supply power from a rechargeable battery device 455 to the load 460, the difference between the estimated maximum power consumption and the power actually consumed by the load 460 is calculated on the basis of the current detection result obtained by the current detection circuit 471. The power limit value of the fusing control circuit 330 then can be increased by the corresponding surplus power. In addition, since the detection signal obtained by the current detection circuit 471 is an analog signal, if a power limit value corresponding to the analog value is prepared in the form of a table in advance, the image forming control circuit 316 can select a power limit value for fusing by referring to the table.

As is obvious from the above description, when the power consumed by the load 460 is small (motor torque is small), since more power can be supplied to a fusing device 23 as the power consumed by the load 460 becomes smaller, further optimal power supply can be done at the time of starting up the fusing device 23 (at turn-on).

Figure 14:
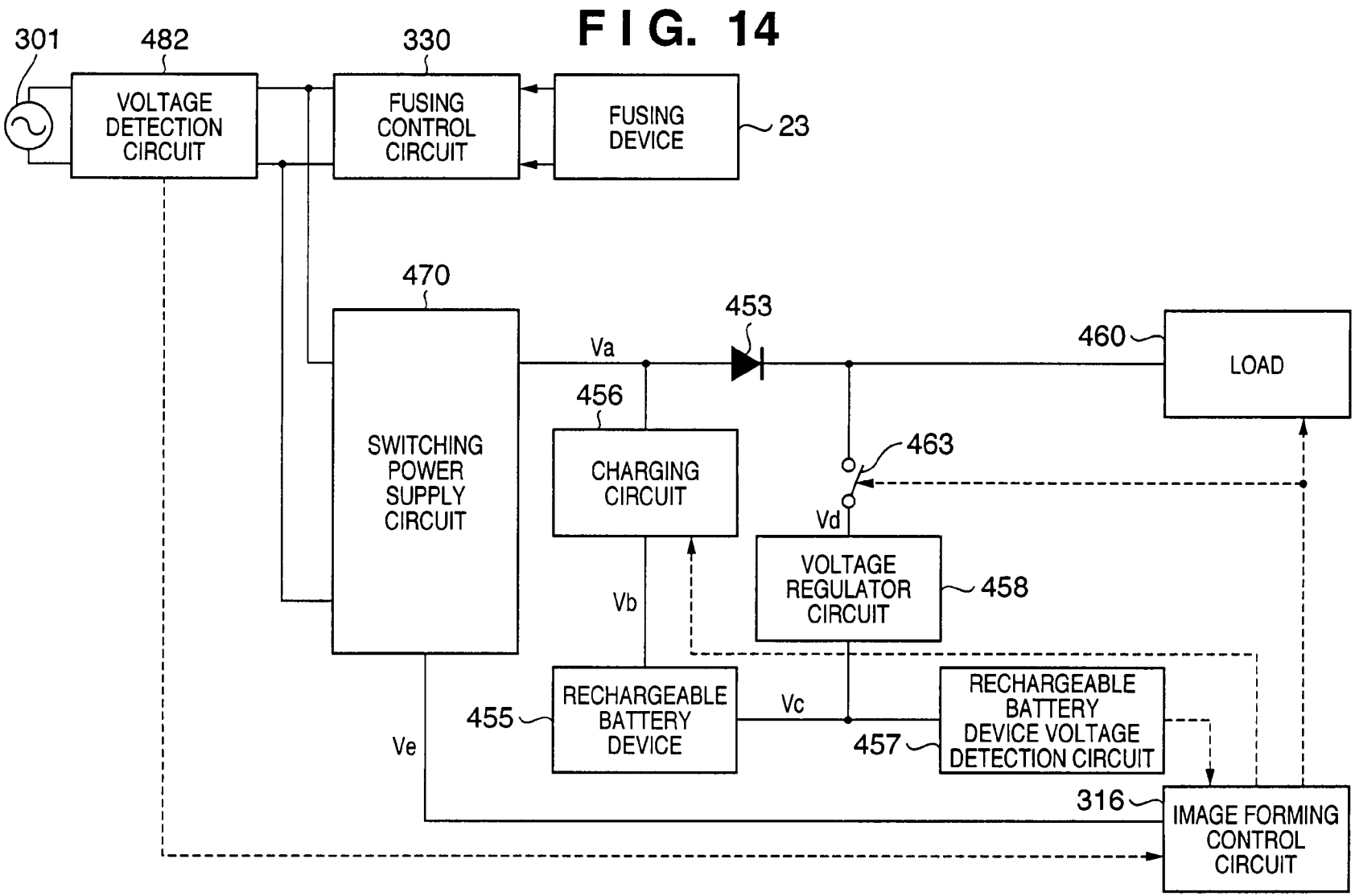
FIG. 14 is a block diagram showing the arrangement of the power supply control system of a laser beam printer according to a modification to the second embodiment.

FIG. 14 shows a modification to this embodiment, in which a voltage detection circuit 482 which detects the voltage of the commercial power supply 301 is provided on the input side (primary side) of the switching power supply circuit 470, instead of the current detection circuit 471. A voltage detected by the voltage detection circuit 482 is a physical quantity corresponding to the power supplied from the commercial power supply 301 to the load 460.

The voltage detection circuit 482 detects the root mean square value or mean value of voltages of the commercial power supply 301, and transmits the detection value, as, for example, an analog signal, to the A/D port of the CPU (not shown) in the image forming control circuit 316. The image forming control circuit 316 changes the reference voltage Vs 326 of the fusing control circuit 330 in accordance with the voltage detection result obtained by the voltage detection circuit 482, thereby changing the power limit value into a predetermined value.

In general, the limit power of the commercial power supply 301 is specified by a current value, although it depends on the standards specified in each country where the laser beam printer 100 is used. Assume that there is a commercial power supply that can supply currents up to 15 A. In this case, as the commercial power supply voltage value increases, larger power can be supplied. In addition, a current flowing in the input side (primary side) of the switching power supply increases as the input voltage decreases, assuming that the power consumed on the secondary side is constant. As a consequence, the current (power) that can be supplied to the fusing device side decreases.

In an arrangement having no means for detecting an input voltage as in the first embodiment, a power limit value needs to be set in the fusing control circuit 330 in advance within the input voltage range so as not to exceed the maximum current value that can be supplied from the commercial power supply in consideration of (1) the maximum supply current (power) of the commercial power supply in the input voltage range, and (2) changes in current in the switching power supply with changes in input voltage, which can be regarded as parameters in determining a power limit value in the fusing device 23. That is, this control is performed with a sufficient surplus capacity with respect to the maximum supply current (power) of the commercial power supply depending on the input voltage.

With the arrangement having the voltage detection circuit 482 to detect an input voltage (commercial power supply voltage) as shown in FIG. 14, a data table containing optimal fusing power limit values corresponding to the analog values of detected input voltages and the above parameters (1) and (2) can be provided in advance. Further optimal power can therefore be supplied to the fusing device 23 at the time of startup (at turn-on) without being influenced by variations in input voltage by referring to the table on the basis of the input voltage (commercial power supply voltage) detected by the voltage detection circuit 482.

An example of power control based on the arrangement shown in FIG. 14 will be described below.

Figure 24:
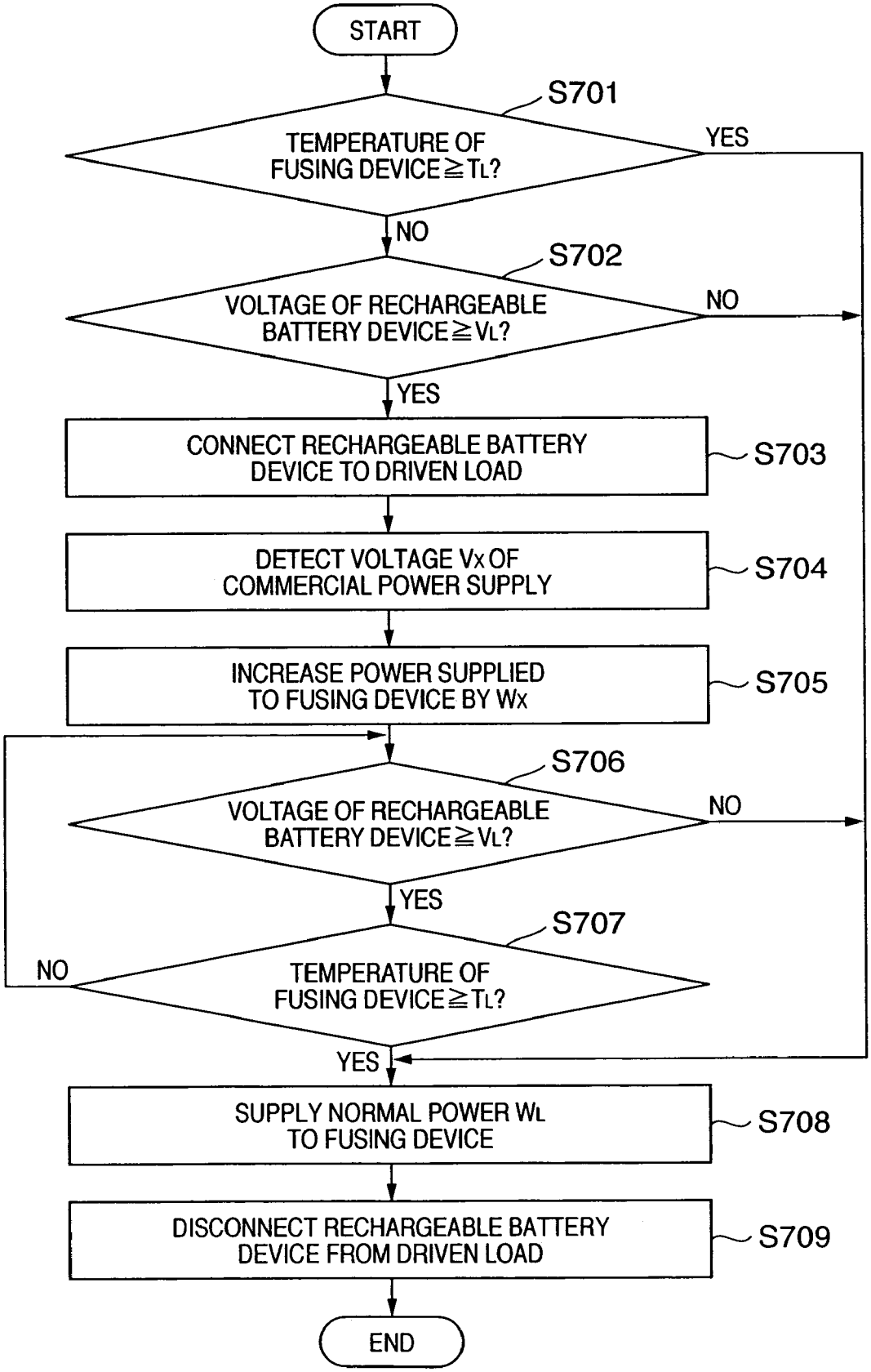
FIG. 24 is a flowchart showing power control operation to be done in consideration of the charged state of a rechargeable battery device and/or the temperature of the fusing device in the second embodiment.

FIG. 24 is a flowchart showing power control operation by the image forming control circuit 316 in this embodiment. This processing is started at turn-on or upon returning from the energy saving mode.

First of all, in step S701, the image forming control circuit 316 receives the temperature detection value from a thermistor 406 (see FIG. 9) provided in the fusing device 23, and determines whether or not the temperature detection value is equal to or more than a lower limit temperature $T_L$ at which fusing can be done. If the temperature of the fusing device 23 has already been equal to or more than the lower limit temperature $T_L$ at which fusing can be done, since there is no need to quickly start the fusing device 23 by supplying power from a rechargeable battery device 455, the flow advances to step S708 to supply normal power $W_L$ from the commercial power supply 301 by maintaining the OFF state of the switch 463. Step S709 following step S708 is the step of disconnecting the rechargeable battery device 455 from the load 460. In this case, however, since the switch 463 has been maintained in the OFF state, this processing is terminated in this state.

If it is determined in step S701 that the temperature detection value obtained by the thermistor 406 (i.e., the temperature of the fusing device 23) is less than $T_L$, the flow advances to step S702 to determine whether or not a charged voltage Vc of the rechargeable battery device 455 which is detected by a rechargeable battery device voltage detection circuit 457 is equal to or more than a lower limit voltage $V_L$ which can be stepped up by a voltage regulator circuit 458 to a voltage Vd required to drive a load 460. If the charged voltage Vc of the rechargeable battery device 455 is less than $V_L$, it is determined that the rechargeable battery device 455 is in an undercharged state, and the flow advances to step S708 as in the case wherein it is determined in step S701 that the temperature of the fusing device 23 has already been equal to or more than the lower limit temperature $T_L$ at which fusing can be done.

If it is determined in step S702 that the charged voltage Vc is equal to or more than $V_L$, the flow advances to step S703 to turn on the switch 463 to connect the rechargeable battery device 455 to the load 460. The load 460 is therefore driven by power from the rechargeable battery device 455.

In step S704, the image forming control circuit 316 receives the commercial power supply voltage detected by the voltage detection circuit 482. The image forming control circuit 316 stores in advance, in an internal memory (not shown), a table describing the correspondence between the voltage of the commercial power supply 301 and the power increase supplied to the fusing device 23. In this table, for example, power increases $W_1$ to $W_n$ supplied to the fusing device 23 are described in correspondence with $V_1$ to $V_n$ in a predetermined voltage range (e.g., 100 to 127 V). In step S705, the image forming control circuit 316 refers to this table to increase the power to be supplied to the fusing device 23 by a power $W_X$ ($W_x$=$W_1$, $W_2$, $W_3$, . . . , $W_n$) corresponding to the commercial power supply voltage $V_x$ ($V_x$=$V_1$, $V_2$, $V_3$, . . . , $V_n$) detected in step S704. More specifically, the operation can be realized by, for example, increasing a reference voltage Vs 326 (see FIG. 9) in a driver circuit 315 of the fusing control circuit 330 by an amount corresponding to a power $W_x$ so as to increase the limit value of power supplied to the fusing device 23.

While power is supplied from the rechargeable battery device 455 to the load 460 in steps S703 to S705, it is monitored in steps S706 and S707 whether or not the charged voltage Vc of the rechargeable battery device 455 which is detected by the rechargeable battery device voltage detection circuit 457 is maintained at the lower limit voltage $V_L$ which can be stepped up by the voltage regulator circuit 458 to the voltage Vd required to drive the load 460, and whether or not the temperature detection value obtained by the thermistor 406 has become equal to or more than the lower limit temperature $T_L$ at which fusing can be done by the fusing device 23.

If the charged voltage Vc of the rechargeable battery device 455 becomes lower than $V_L$ (NO in step S706) or the temperature detection value obtained by the thermistor 406 (i.e., the temperature of the fusing device 23) becomes equal to or higher than $T_L$ (YES in step S707), the flow advances to step S708 to return the power supplied to the fusing device 23 to the normal power. More specifically, this operation can be realized by, for example, decreasing the reference voltage Vs 326 (see FIG. 9) in the driver circuit 315 of the fusing control circuit 330 by an amount corresponding to the power $W_x$, by which the supply power is increased in step S705, to decrease the limit value of power supplied to the fusing device 23.

In step S709, the switch 463 is turned off to disconnect the rechargeable battery device 455 from the load 460. This processing is then terminated.

Figure 15:
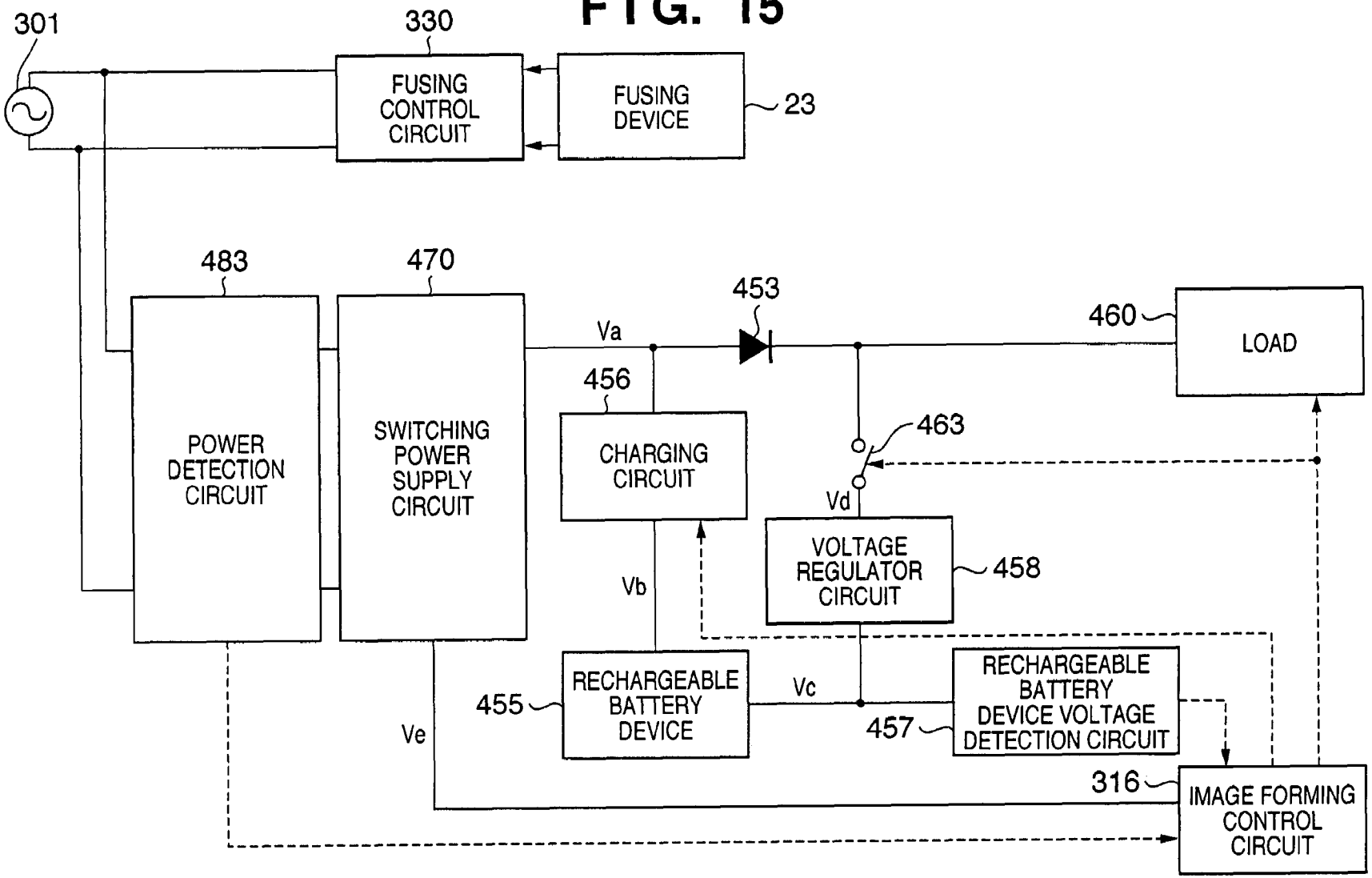
FIG. 15 is a block diagram showing the arrangement of the power supply control system of a laser beam printer according to another modification to the second embodiment.

FIG. 15 shows another modification to this embodiment, in which a power detection circuit 483 which detects power supplied from the commercial power supply 301 to the load 460 is provided on the input side (primary side) of the switching power supply circuit 470 instead of the current detection circuit 471.

The power detection circuit 483 detects the root mean square value or mean value of powers on the input side (primary side) of the switching power supply circuit 470, and transmits the detection value, as, for example, an analog signal, to the A/D port of the CPU (not shown) in the image forming control circuit 316. While power is supplied from the rechargeable battery device 455, the image forming control circuit 316 changes the reference voltage Vs 326 of the fusing control circuit 330 in accordance with the power detection result obtained by the power detection circuit 483, thereby changing the power limit value into a predetermined value.

Note that both the current detection circuit 471 and the voltage detection circuit 482 described above may be provided instead of the power detection circuit 483, and the image forming control circuit 316 may compute power from the current value and voltage value respectively detected by these circuits.

If power limit values corresponding to input-side powers in the switching power supply circuit 470 are prepared in the form of a data table, the image forming control circuit 316 can select a power limit value for fusing, on the basis of the power value detected by the power detection circuit 483, by referring to a limit value in the table which corresponds to the power value.

Third Embodiment

Figure 16:
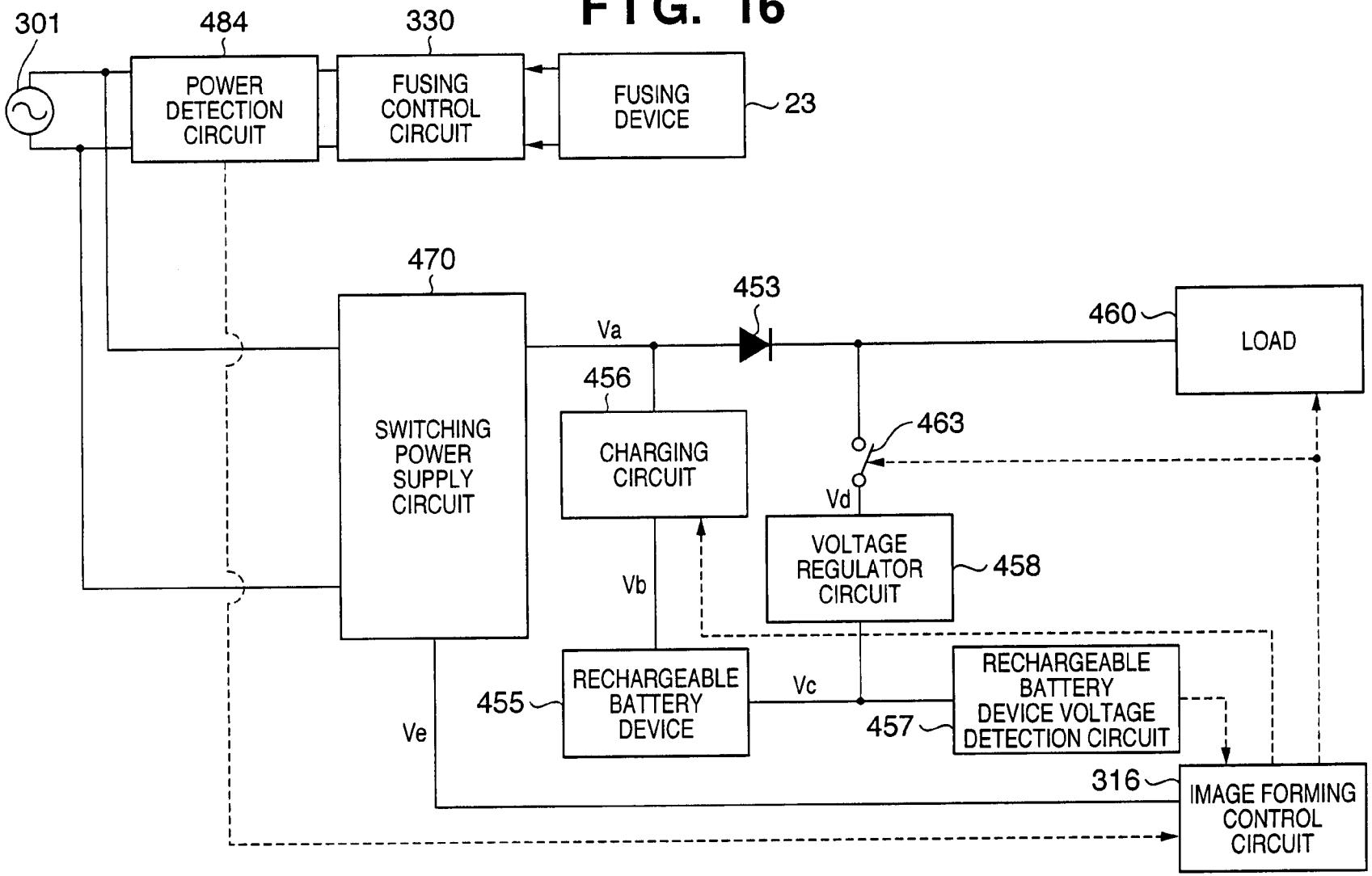
FIG. 16 is a block diagram showing the arrangement of a power supply control system of a laser beam printer according to a third embodiment.

FIG. 16 is a block diagram showing the arrangement of the power supply control system of a laser beam printer 100 according to the third embodiment. This embodiment differs from the third modification (FIG. 15) to the second embodiment in that a power detection circuit 484 is provided on the input side of a fusing control circuit 330 instead of the input side (primary side) of a switching power supply circuit 470. The power detected by the power detection circuit 484 is power supplied from a commercial power supply 301 to a fusing device 23.

The power detection circuit 484 detects the root mean square value or mean value of powers on the input side (primary side) of the fusing control circuit 330, and transmits the detection value, as, for example, an analog signal, to the A/D port of the CPU (not shown) in an image forming control circuit 316. While power is supplied from the rechargeable battery device 455, the image forming control circuit 316 changes a reference voltage Vs 326 (FIG. 9) of the fusing control circuit 330 in accordance with the power detection result obtained by the power detection circuit 484, thereby changing the power limit value into a predetermined value.

Note that the voltage detection circuit 482 shown in FIG. 14 may be provided instead of the power detection circuit 484 to detect a power value, and the image forming control circuit 316 may compute power from the voltage value and the switching current value detected by a current transformer 311.

If power limit values corresponding to input-side powers in the fusing control circuit 330 are prepared in the form of a data table, the image forming control circuit 316 can select a power limit value for fusing, on the basis of the power value detected by the power detection circuit 484, by referring to a limit value in the table which corresponds to the power value.

Fourth Embodiment

Figure 17:
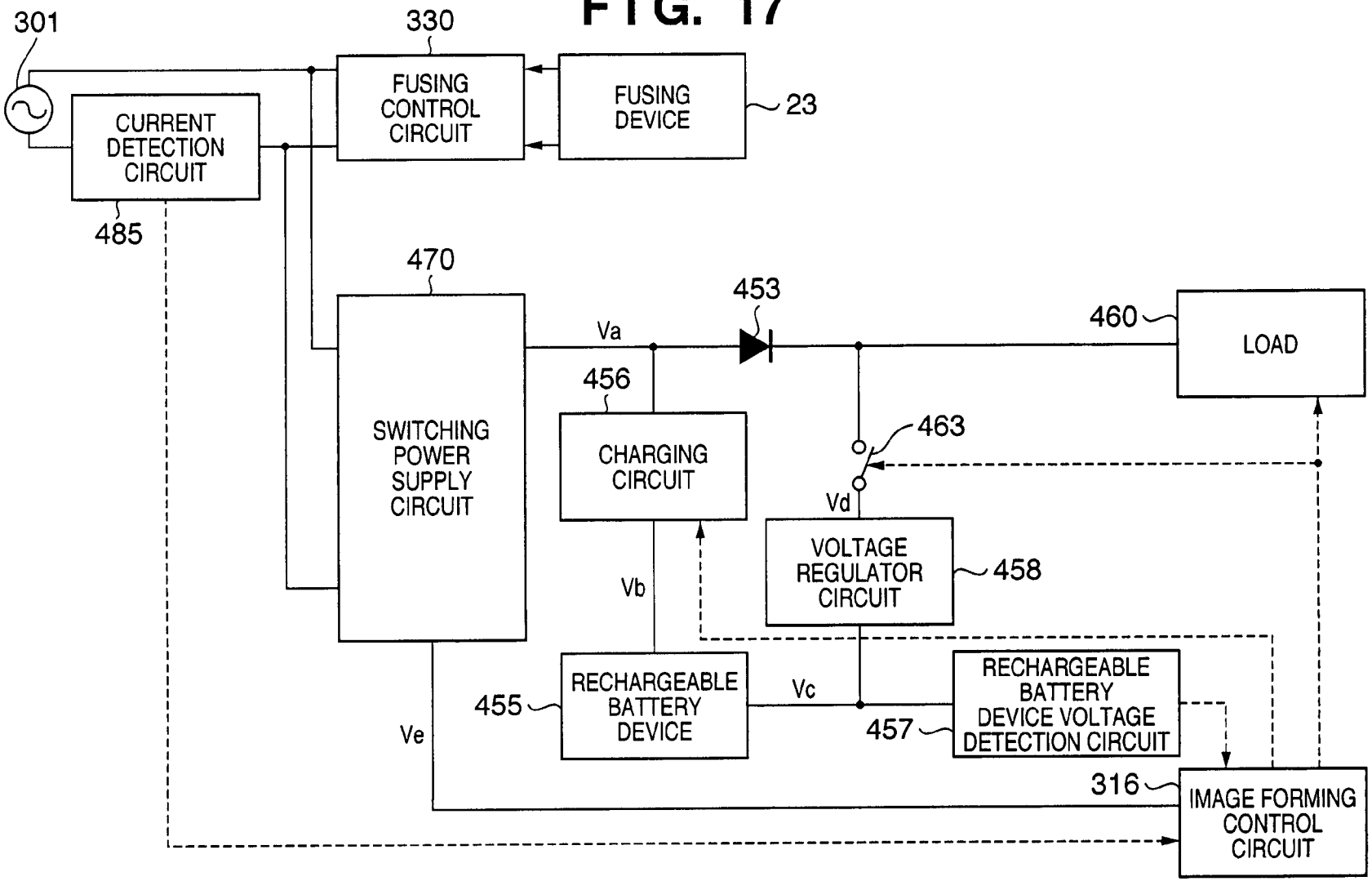
FIG. 17 is a block diagram showing the arrangement of a power supply control system of a laser beam printer according to fourth embodiment.

FIG. 17 is a block diagram showing the arrangement of the power supply control system of a laser beam printer 100 according to the fourth embodiment. This embodiment differs from the second embodiment (FIG. 13) in that a current detection circuit 485 is provided on a stage before a branch point to the input side (primary side) of a switching power supply circuit 470 to detect a current in a commercial power supply 301. The current detected by the current detection circuit 485 is a physical quantity corresponding to the power of the commercial power supply 301.

The current detection circuit 485 detects the root mean square value or mean value of input currents flowing in the commercial power supply 301, and transmits the detection value, as, for example, an analog signal, to the A/D port of the CPU (not shown) in an image forming control circuit 316. The image forming control circuit 316 changes a reference voltage Vs 326 (FIG. 9) of a fusing control circuit 330 in accordance with the current detection result obtained by the current detection circuit 485, thereby changing the power limit value into a predetermined value.

In general, the limit power of the commercial power supply 301 is specified by a current value, although it depends on the standards specified in each country where the laser beam printer 100 is used. Assume that there is a commercial power supply that can supply currents up to 15 A. In this case, as the commercial power supply voltage value increases, larger power can be supplied. That is, further optimal fusing power control can be performed by detecting a current flowing in the commercial power supply 301 using the current detection circuit 485 as in this embodiment.

While monitoring the current value detected by the current detection circuit 485, the image forming control circuit 316 controls a fusing power limit value in real time so as to make the maximum current value of the detected current fall within a current of 15 A that can be supplied by the commercial power supply 301. More specifically, at the startup of fusing, the image forming control circuit 316 turns on a switch 463 to supply power from a rechargeable battery device 455 to a load 460, and sets a predetermined power limit value to prevent the maximum current value from exceeding 15 A. The image forming control circuit 316 then increases the fusing power limit value by a power corresponding to the difference between the maximum current value detected by the current detection circuit 485 and the current (power) that can be supplied from the commercial power supply 301. This makes it possible to perform optimal fusing power control.

Figure 25:
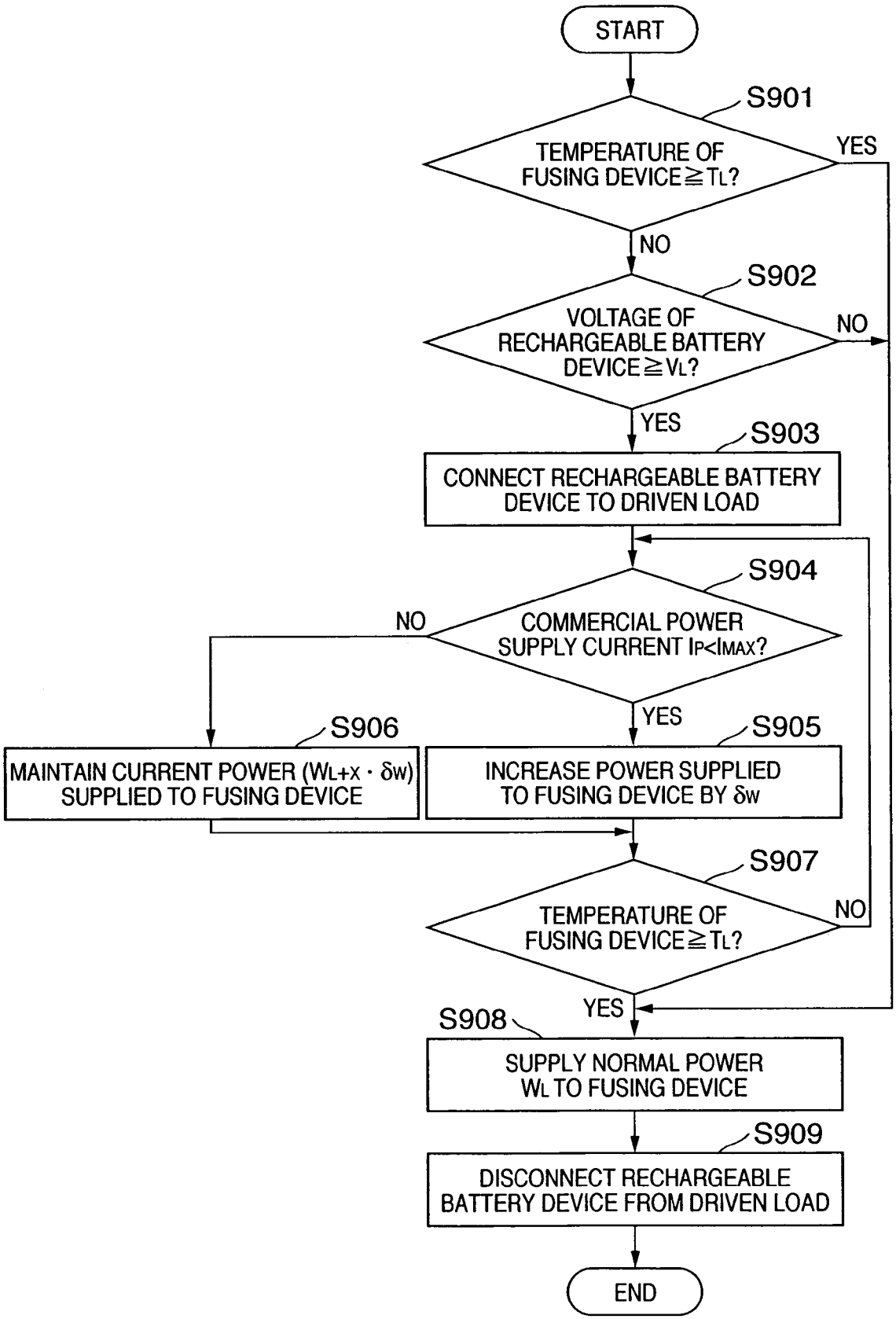
FIG. 25 is a flowchart showing power control operation to be done in consideration of the charged state of a rechargeable battery device and/or the temperature of the fusing device in the fourth embodiment.

FIG. 25 is a flowchart showing power control operation by the image forming control circuit 316 in this embodiment. This processing is started at turn-on or upon returning from the energy saving mode.

First of all, in step S901, the image forming control circuit 316 receives the temperature detection value from a thermistor 406 provided in a fusing device 23 (see FIG. 9), and determines whether or not the temperature detection value is equal to or more than a lower limit temperature $T_L$ at which fusing can be done. If the temperature of the fusing device 23 has already been equal to or more than the lower limit temperature $T_L$ at which fusing can be done, since there is no need to quickly start the fusing device 23 by supplying power from the rechargeable battery device 455, the flow advances to step S908 to supply normal power $W_L$ from the commercial power supply 301 by maintaining the OFF state of the switch 463. Step S909 following step S908 is the step of disconnecting the rechargeable battery device 455 from the load 460. In this case, however, since the switch 463 has been maintained in the OFF state, this processing is terminated in this state.

If it is determined in step S901 that the temperature detection value obtained by the thermistor 406 (i.e., the temperature of the fusing device 23) is less than $T_L$, the flow advances to step S902 to determine whether or not a charged voltage Vc of the rechargeable battery device 455 which is detected by a rechargeable battery device voltage detection circuit 457 is equal to or more than a lower limit voltage $V_L$ which can be stepped up by a voltage regulator circuit 458 to the voltage Vd required to drive the load 460. If the charged voltage Vc of the rechargeable battery device 455 is less than $V_L$, it is determined that the rechargeable battery device 455 is in an undercharged state, and the flow advances to step S908 as in the case wherein it is determined in step S901 that the temperature of the fusing device 23 has already been equal to or more than the lower limit temperature $T_L$ at which fusing can be done.

If it is determined in step S902 that the charged voltage Vc is equal to or more than $V_L$, the flow advances to step S903 to turn on the switch 463 to connect the rechargeable battery device 455 to the load 460. The load 460 is therefore driven by power from the rechargeable battery device 455.

In step S904, the image forming control circuit 316 receives a current $I_p$ from the commercial power supply 301, which is detected by the current detection circuit 485, and monitors whether the current $I_p$ is less than an upper current limit value $I_{max}$ (e.g., 15 A) of the commercial power supply 301. If it is confirmed that the current $I_p$ is less than $I_{max}$, the flow advances to step S905 to increase the power supplied to the fusing device 23 by $\delta_W$. More specifically, this operation can be realized by increasing the reference voltage Vs 326 (see FIG. 9) in the driver circuit 315 of the fusing control circuit 330 by an amount corresponding to the power $\delta_W$ so as to increase the limit value of power supplied to the fusing device 23. The power supplied to the fusing device 23 as a result of this operation is a power $W_L+\delta_W$ (where $W_L$ is the normal power from the commercial power supply 301). Thereafter, the flow advances to step S907 to check whether the temperature detection value obtained by the thermistor 406 becomes equal to or more than the lower limit temperature $T_L$ at which the fusing device 23 can perform fusing. If the temperature detection value obtained by the thermistor 406 is less than $T_L$ (NO in step S907), the flow returns to step S904 to repeat the processing.

When the above processing loop of steps S904, S905, and S907 is repeated x times, the power supplied to the fusing device 23 becomes larger than the normal power $W_L$ from an operating portion body 310 (FIG. 9) by $x \cdot \delta_W$. If the condition of $I_p < I_{max}$ is not satisfied in step S904 after this processing loop is repeated by x times, the flow advances to step S906 to maintain the power supplied to the fusing device 23 at $W_L + x \cdot \delta_W$. The flow then advances to step S907.

If it is determined in step S907 that the temperature detection value obtained by the thermistor 406 becomes equal to or more than $T_L$ (YES in step S907), the flow advances to step S908 to return the power supplied to the fusing device 23 to the normal power $W_L$. More specifically, this operation can be realized such that the reference voltage Vs 326 (see FIG. 9) in the driver circuit 315 of the fusing control circuit 330 is decreased by the power increase $x \cdot \delta_W$, which is obtained by repeating the loop of steps S905 to S907 by x times, thereby decreasing the limit value of power supplied to the fusing device 23.

The switch 463 is then turned off in step S909 to disconnect the rechargeable battery device 455 from the load 460, and this processing is terminated.

According to the above power control, the current $I_p$ in the commercial power supply 301 is detected, and the power supplied to the fusing device 23 is controlled in accordance with the detection result. This makes it possible to effectively use the commercial power supply 301 independently of the power supplied from the rechargeable battery device 455 to the load 460. Therefore, the fusing device 23 can be started up more quickly to a state wherein it can perform fusing.

In the above case of power control, there is no description about the step of detecting the voltage of the rechargeable battery device 455. However, the voltage of the rechargeable battery device 455 is preferably detected at a predetermined timing because it facilitates control to prevent $I_p$ from exceeding $I_{max}$ when the capacity of the rechargeable battery device 455 decreases to result in an abrupt drop in output or a failure has occurred in the rechargeable battery device 455.

Figure 18:
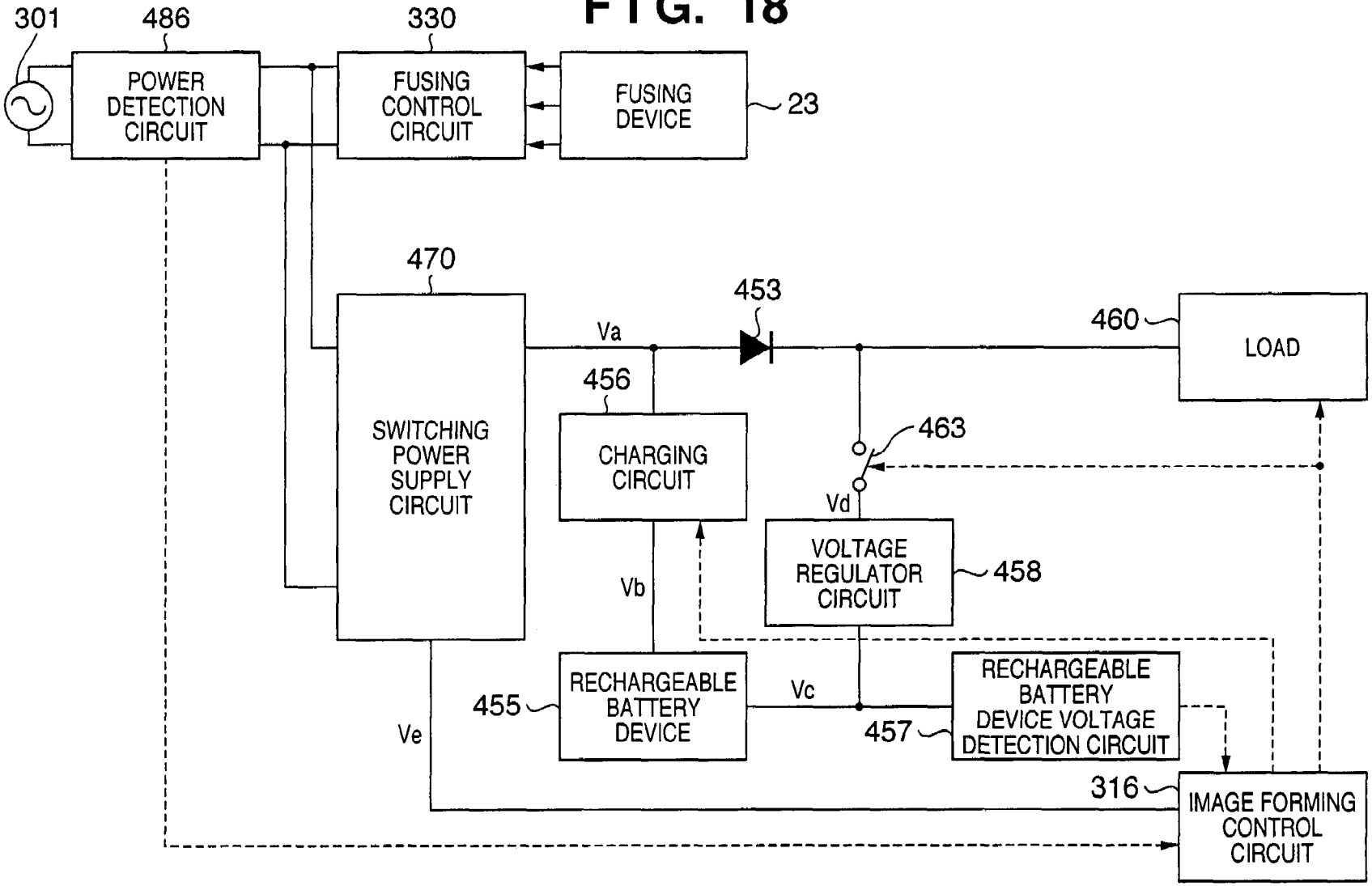
FIG. 18 is a block diagram showing the arrangement of the power supply control system of a laser beam printer according to a modification to the fourth embodiment.

FIG. 18 shows a modification to this embodiment, in which a power detection circuit 486 is provided, instead of the current detection circuit 485, on a stage before a branch point to the input side (primary side) of the switching power supply circuit 470 to detect the power of the commercial power supply 301.

The power detection circuit 486 detects the root mean square value or mean value of powers on the input side (primary side) of the fusing control circuit 330, and transmits the detection value, as, for example, an analog signal, to the A/D port of the CPU (not shown) in the image forming control circuit 316. The image forming control circuit 316 changes the reference voltage Vs 326 (FIG. 9) of the fusing control circuit 330 in accordance with the power detection result obtained by the power detection circuit 486, thereby changing the power limit value into a predetermined value.

Note that both the current detection circuit 485 and the voltage detection circuit 482 described above may be provided instead of the power detection circuit 486, and the image forming control circuit 316 may compute power from the current value and voltage value respectively detected by these circuits.

If power limit values corresponding to input-side powers in the fusing control circuit 330 are prepared in the form of a data table, the image forming control circuit 316 can select a power limit value for fusing, on the basis of the power value detected by the power detection circuit 486, by referring to a limit value in the table which corresponds to the power value.

Fifth Embodiment

In each embodiment described above, the fusing device 23 of the electromagnetic induction heating system is used. However, fusing devices based on other systems can also be used. In the fifth embodiment, a fusing device based on a ceramic sheet heater system will be described.

Figure 19:
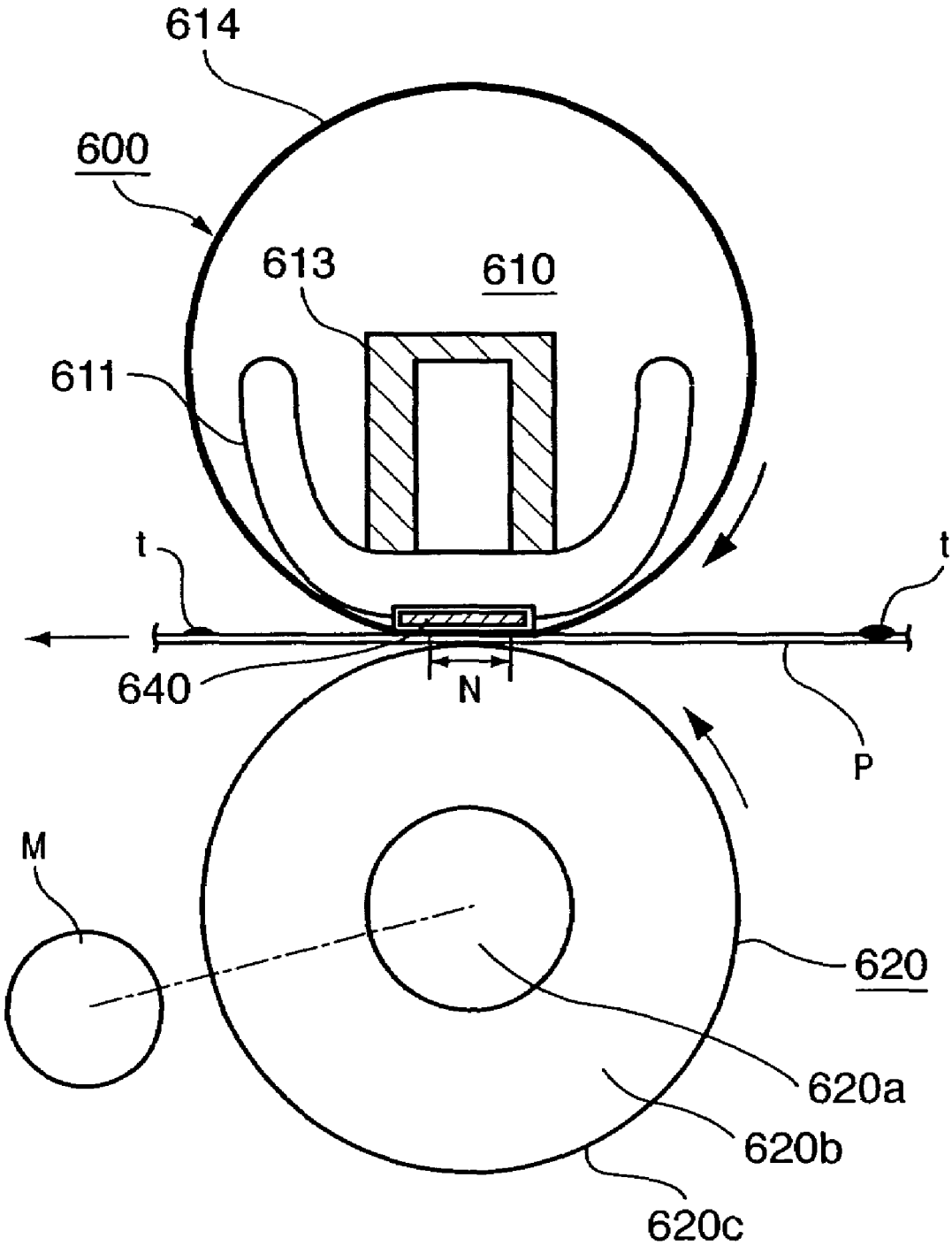
FIG. 19 is a view showing the cross-sectional structure of a fusing device based on a ceramic sheet heater system according to a fifth embodiment.

FIG. 19 is a view showing the cross-sectional structure of a fusing device 600 based on the ceramic sheet heater system according to this embodiment.

Reference numeral 610 denotes a stay. The stay 610 is comprised of a main body portion 611 which has a U-shaped cross-section and supports a ceramic sheet heater 640 in an exposed state and a pressurizing portion 613 which pressurizes the main body portion 611 toward a pressurized roller 620 which faces the main body portion 611. In this case, the ceramic sheet heater may have a heating element located on the opposite side to the nip portion N (to be described later) or on the nip portion side. Reference numeral 614 denotes a heat-resistant film (to be simply referred to as a "film" hereinafter) which has a circular cross-section and is fitted on the stay 610.

The pressurized roller 620 forms a pressure contact nip portion (fusing nip portion) N with the film 614 being clamped between the pressurized roller 620 and the ceramic sheet heater 640, and also functions as a film outer surface contact driving means for rotating/driving the film 614. The film driving roller/pressurized roller 620 is comprised of a cored bar 620*a*, an elastic layer 620*b* made of silicone rubber or the like, and a release layer 620*c* which is the outermost layer, and is in tight contact with the surface of the ceramic sheet heater 640 with the film 614 being clamped between them with a predetermined pressing force from a bearing means/biasing means (not shown). The pressurized roller 620 is rotated/driven by a motor M to give conveying force to the film 614 with the frictional force with the outer surface of the film 614.

Figure 20B:
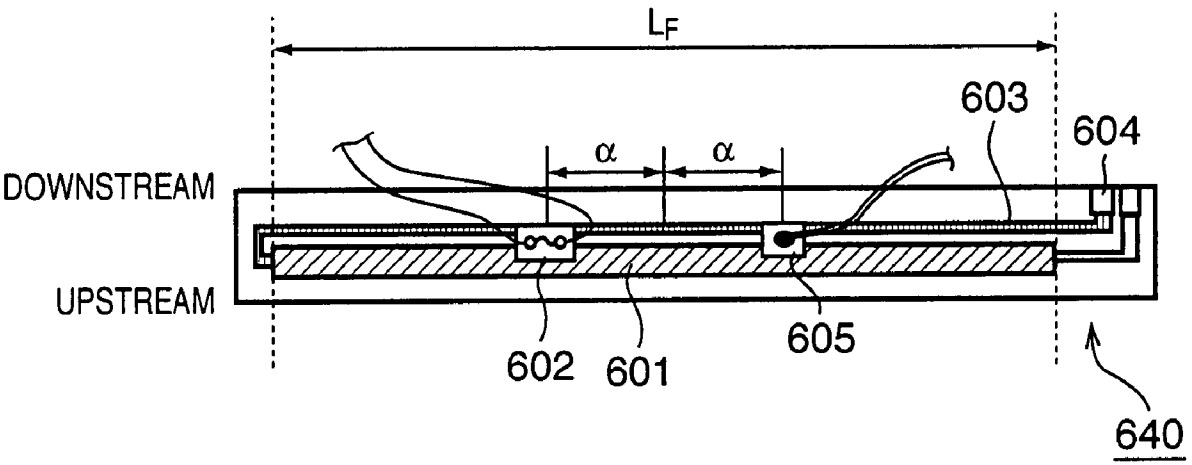
FIGS. 20A and 20B are views showing an example of the structure of a ceramic sheet heater in the fifth embodiment.
Figure 20A:
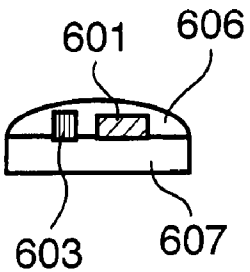

FIGS. 20A and 20B are views showing a specific example of the structure of the ceramic sheet heater 640. FIG. 20A is a sectional view of the ceramic sheet heater 640. FIG. 20B shows the surface on which a heating element 601 is formed.

The ceramic sheet heater 640 is comprised of a ceramic-based insulating substrate 607 made of SiC, AlN, $Al_2O_3$, or the like, the heating element 601 formed on the insulating substrate surface by paste printing or the like, a protective layer 606 which is made of glass or the like and protects the heating element 601. A thermistor 605 serving as a temperature detection element which detects the temperature of the ceramic sheet heater 640 and a means for preventing excessive temperature rise, for example, a temperature fuse 602 are arranged on the protective layer 606. The thermistor 605 is placed through an insulator having a high breakdown voltage which can ensure an insulation distance from the heating element 601. As a means for preventing excessive temperature rise, a thermoswitch or the like may be used in place of a temperature fuse 602.

The heating element 601 is comprised of a portion which generates heat upon reception of power, a conductive portion 603 connected to the heating portion, and electrode portions 604 to which power is supplied through a connector. The heating element 601 has a length almost equal to a maximum printing sheet width LF that can pass through the printer. The HOT-side terminal of an AC power supply is connected to one of the two electrode portions 604 through the temperature fuse 602. The electrode portions 604 are connected to a triac 639 (FIG. 21) which controls the heating element 601 and to the NEUTRAL terminal of the AC power supply.

Figure 21:
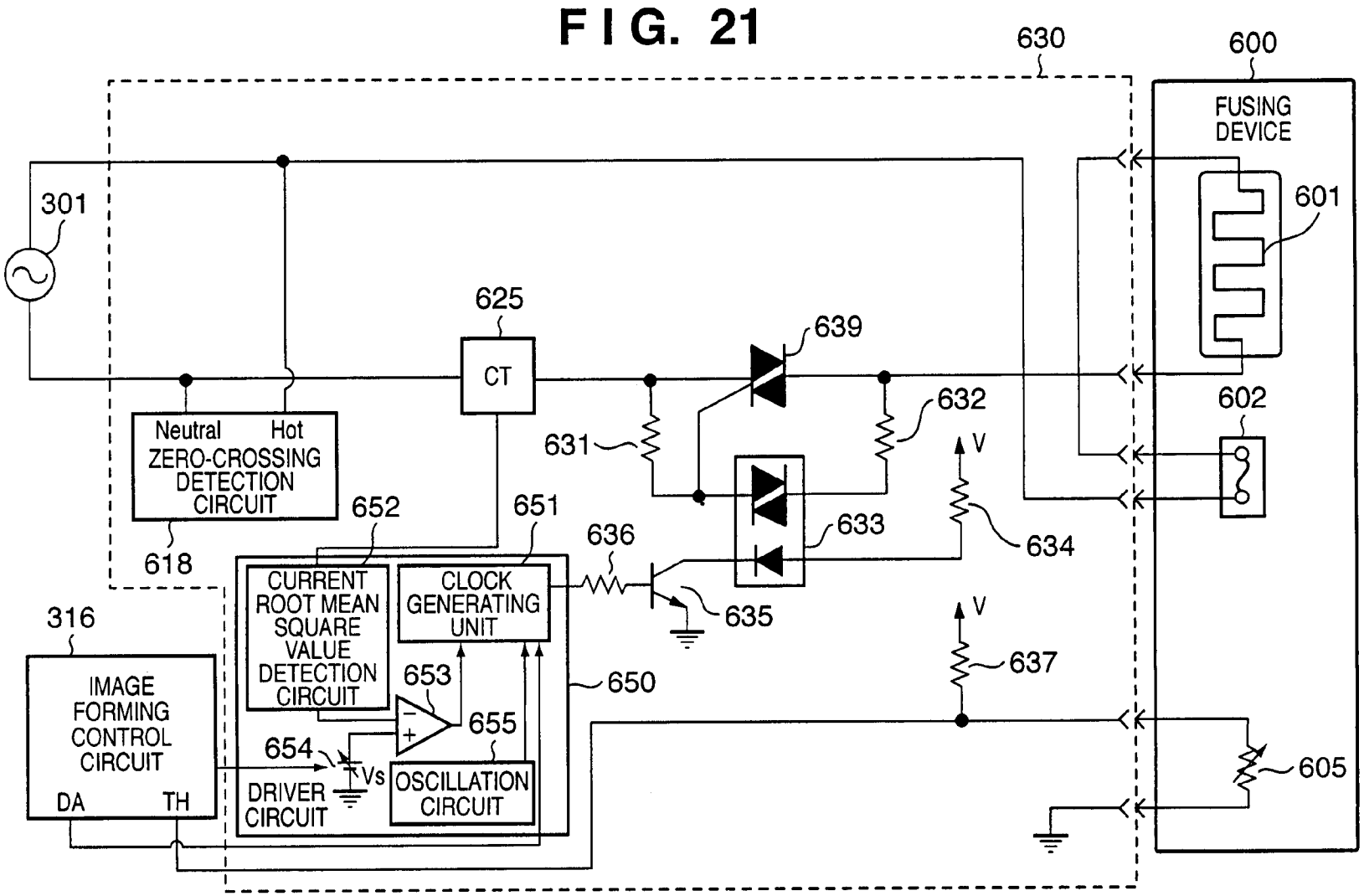
FIG. 21 is a view showing the arrangement of a fusing control circuit in the fifth embodiment.

FIG. 21 is a view showing the arrangement of a fusing control circuit 630 in this embodiment. The fusing control circuit 630 is based on the ceramic sheet heater system, but can be replaced with the fusing control circuit 330 shown in FIG. 3.

A laser beam printer 100 according to this embodiment supplies power from a commercial power supply 301 to the heating element 601 of the ceramic sheet heater 640 through an AC filter (not shown) to cause the heating element 601 of the ceramic sheet heater 640 to generate heat. This supply of power to the heating element 601 is controlled by the triac 639. Resistors 631 and 632 are bias resistors for the triac 639. A phototriac coupler 633 is a device for isolating the primary side from the secondary side. When a light-emitting diode of the phototriac coupler 633 is energized, the triac 639 is turned on. A resistor 634 is a resistor for limiting a current in the phototriac coupler 633, and is turned on/off by a transistor 635. The transistor 635 operates in accordance with an ON signal sent from an image forming control circuit 316 through a driver circuit 650 and resistor 636. The driver circuit 650 is comprised of a current root mean square value detection circuit 652, oscillation circuit 655, comparator 653, reference voltage Vs 654, and clock generating unit 651.

AC power is input to a zero-crossing detection circuit 618 through an AC filter (not shown). The zero-crossing detection circuit 618 notifies the clock generating unit 651, by using a pulse signal, that the voltage of the commercial power supply 301 has become equal to or less than a threshold. This signal transmitted to the clock generating unit 651 will be referred to as a ZEROX signal hereinafter. The clock generating unit 651 detects the edge of a pulse of the ZEROX signal.

The temperature detected by a thermistor 605 is detected as a divided voltage obtained by a resistor 637 and the thermistor 605, and is input as a TH signal to the image forming control circuit 316 upon being A/D-converted. The temperature of the ceramic sheet heater 640 is monitored as the TH signal by the image forming control circuit 316. The result obtained by comparing this temperature with the set temperature of the ceramic sheet heater 640 which is set in the image forming control circuit 316 is transmitted to the clock generating unit 651 by using an analog signal from the D/A port of the image forming control circuit 316 or by PWM. The clock generating unit 651 calculates power to be supplied to the heating element 601 as an element of the ceramic sheet heater 640 on the basis of the signal sent from the image forming control circuit 316, and converts it into a phase angle θ (phase control) corresponding to the power to be supplied. The zero-crossing detection circuit 618 outputs the ZEROX signal to the clock generating unit 651. The clock generating unit 651 synchronously transmits an ON signal to the transistor 635 to energize the heater 640 at a predetermined phase angle θa.

Figure 22:
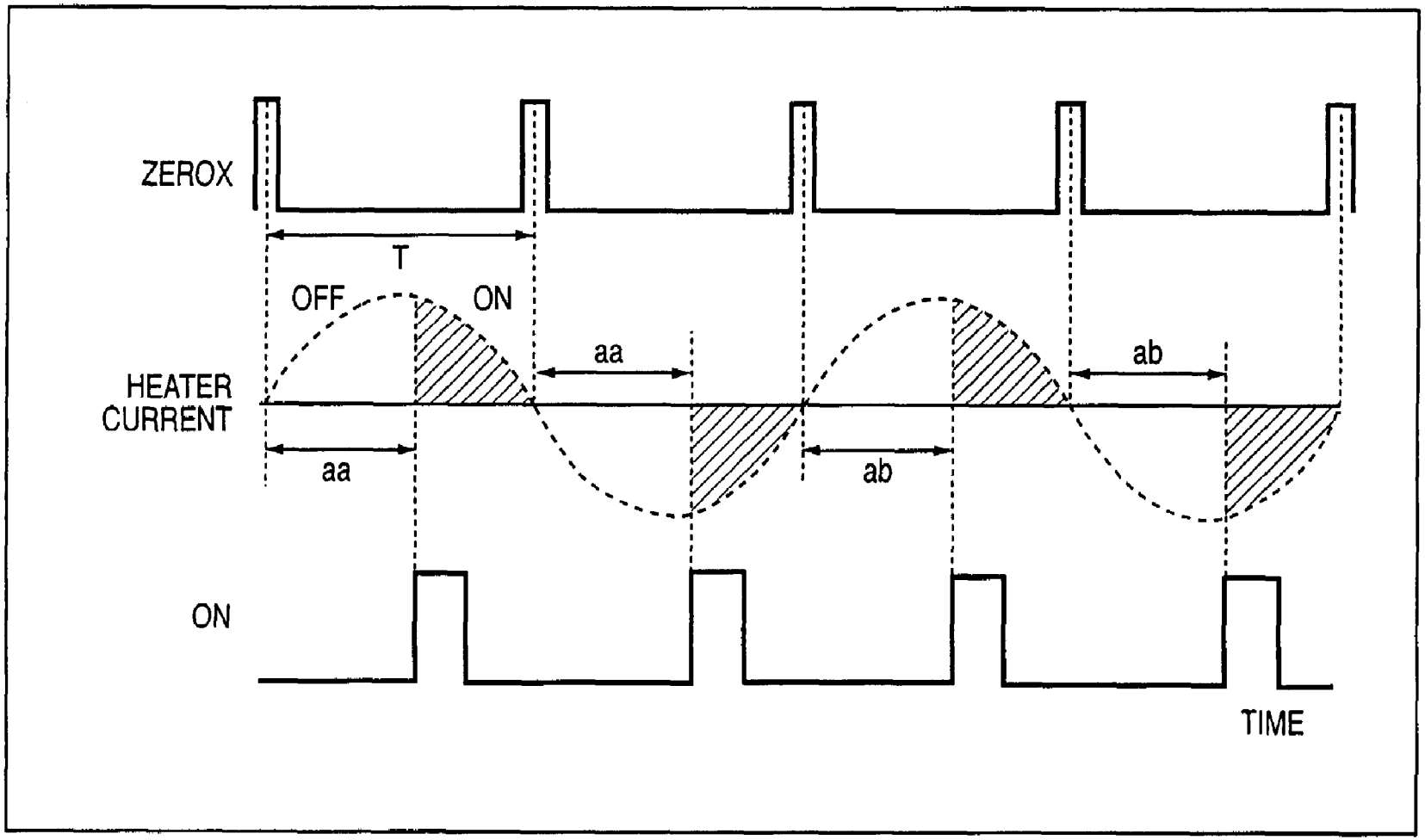
FIG. 22 is a timing chart for explaining energization control for the fusing device by an image forming control circuit in the fifth embodiment.

FIG. 22 shows waveforms which appear while the heater is energized. The ZEROX signal is a repetitive pulse having a period T (=1/50 sec) determined by the commercial power supply frequency (50 Hz), which is transmitted to the image forming control circuit 316. The middle portion of each pulse indicates the phases 0° and 180° of commercial power and the timing at which the voltage becomes 0 V (zero-crossing). The image forming control circuit 316 performs control to transmit the ON signal for turning on the triac 639 at a predetermined timing after the zero-crossing timing and start energizing the heating element (heater) 601 at the predetermined phase angle θa in a half-wave of a commercial power supply voltage (sine wave). The triac 639 is turned off at the next zero-crossing timing, and the heating element 601 is started to be energized by the ON signal at the phase angle θa in the next half-wave. At the next zero-crossing timing, the heating element 601 is turned off. Since the heating element 601 is a resistive element, the waveform of a voltage applied across the two terminals of the heating element 601 becomes equal to that of a current flowing therein. As shown in FIG. 22, the current exhibits symmetrical positive and negative waveforms within one period. When the power supplied to the heater 640 is to be increased, the timing of the transmission of the ON signal with respect to a zero-crossing point is quickened. When the power supplied to the heater 640 is to be decreased, the timing of the transmission of the ON signal with respect to a zero-crossing point is slowed. The temperature of the ceramic sheet heater 640 is controlled by performing this control for one period or a plurality of periods as needed.

Reference numeral 625 in FIG. 21 denotes a current transformer for detecting a current flowing in the ceramic sheet heater 640 of the fusing device 600. The root mean square value of the current detected by the current transformer 625 is measured by the current root mean square value detection circuit 652 comprised of an IC and the like which detects a current root mean square value. The detected current (voltage) value is transmitted to the negative input terminal of the comparator 653. The predetermined reference voltage Vs 654 is transmitted to the positive input terminal of the comparator 653. The comparator 653 then compares the two values. If the current detection value is larger than the reference voltage Vs 654, the comparator 653 outputs the resultant information to the clock generating unit 651 to make the time between a zero-crossing timing and the transmission of the ON signal become equal to or more than a predetermined time (predetermined phase angle) so as prevent a current flowing in the heater 640 from becoming equal to or more than a current corresponding to the reference voltage Vs 654. In the above manner, the image forming control circuit 316 always monitors a current, and determines, from a detected mean current, a phase angle at which a current flowing in the heater 640 does not exceed a predetermined maximum root mean square current, thereby controlling the maximum power to be supplied to the ceramic sheet heater 640.

If the heating element 601 exhibits thermal runaway and the temperature of a temperature fuse 602 rises to a predetermined temperature or higher due to a failure in the image forming control circuit 316 or the like, the temperature fuse 602 opens. When the temperature fuse 602 opens, the current path to the ceramic sheet heater 640 is cut off to interrupt the energization of the heating element 601, thereby providing protection at the time of occurrence of a failure.

In the above arrangement, the following power control is performed in this embodiment.

When the laser beam printer 100 is in a standby state or the rechargeable battery device 455 needs not supply any power, the image forming control circuit 316 turns off a switch 463 and operates a charging circuit 456 to charge the rechargeable battery device 455 in advance.

When the fusing device 23 is to be used at the start of image forming operation or the like, the image forming control circuit 316 turns on the switch 463 to drive a load 460 using power from the rechargeable battery device 455. The supply 301 of power from the rechargeable battery device 455 saves power from the commercial power supply 301 by the amount of power consumed by the load 460. Consequently, this produces a surplus capacity for the maximum power specified by the maximum current of the commercial power supply 301.

Assume that the temperature of the fusing device 23 is raised, a current of 11 A flows in the primary side (AC side) of the fusing control circuit 630, and a current of 3 A flows in the primary side (AC side) of a switching power supply circuit 470. In this case, expecting that variations in power or the like dependent on the input voltage to the fusing control circuit 630 are about 1 A, the total power becomes 15 A (=11 A+3 A+1 A) (assuming that power factors cos θ of the fusing control circuit 630 and switching power supply circuit 470 are both 1). That is, the total power falls within the maximum current, 15 A, of the commercial power supply, i.e., an allowable power of 1,500 W (=100 V×15 A).

Assume that under such a condition, as power has been supplied from the rechargeable battery device 455 to the load 460, the current value on the primary side (AC side) of the switching power supply circuit 470 has decreased by 2 A. In this case, while the load 460 is driven by power from the rechargeable battery device 455, power corresponding to 2 A (200 W=100 V×2 A) from the commercial power supply is saved. This produces a surplus capacity for the maximum supply current of the commercial power supply. The image forming control circuit 316 therefore decreases the phase angle for energization of the ceramic sheet heater 640, which corresponds to the limit value of power supplied to the fusing device 600, toward 0° by an amount corresponding to 2 A so as to increase the limit value of power supplied to the fusing device 23. Consequently, a current of 13 A flows on the primary side (AC side) of the fusing control circuit 630, and a current of 1 A flows on the primary side (AC side) of the switching power supply circuit 470. The variations remain about 1 A. The total current is 15 A (=13 A+1 A+1 A), which falls within the maximum allowable power of the commercial power supply 301, as in the above case. Obviously, actual design must be done in consideration of design variations so as not to exceed the maximum current that can be supplied from the commercial power supply 301.

As described above, the rechargeable battery device 455 is provided in the laser beam printer 100, and power is supplied from the rechargeable battery device 455 to the load 460 such as a motor other than the fusing device 600. This makes it possible to increase the limit value of power supplied to the fusing device 600 by an amount corresponding to a surplus capacity during the supply of power from the rechargeable battery device 455. By effectively using this surplus power as startup power for the fusing device 600, the startup time of the fusing device 600 can be shortened.

In addition, since the fusing device 600 need not incorporate a plurality of heat sources such as a main heater and sub-heater, the arrangement of the fusing device can be simplified. In addition, on-demand fusing can be implemented depending on the arrangement of the image forming apparatus or performance such as printing speed or the like.

Obviously, in an arrangement using a fusing device based on the ceramic sheet heater system like this embodiment, as in the case of a fusing device based on the electromagnetic induction heating system, as described in the second to fourth embodiments, power from the commercial power supply can be effectively used by providing current/voltage/power detection circuits on the primary side of the switching power supply, fusing control circuit, and commercial power supply unit and changing the limit value of fusing power in accordance with at least one of the detection results obtained by the detection circuits and the supply state of power from the rechargeable battery device.

Sixth Embodiment

Each of the first to fifth embodiments uses the switch 463 as a selection means for selecting either the commercial power supply 301 or the rechargeable battery device 455 as a power supply source for the load 460. However, the present invention does not exclude a mode of using both the commercial power supply 301 and the rechargeable battery device 455 as power supply sources for a load 460.

Figure 28:
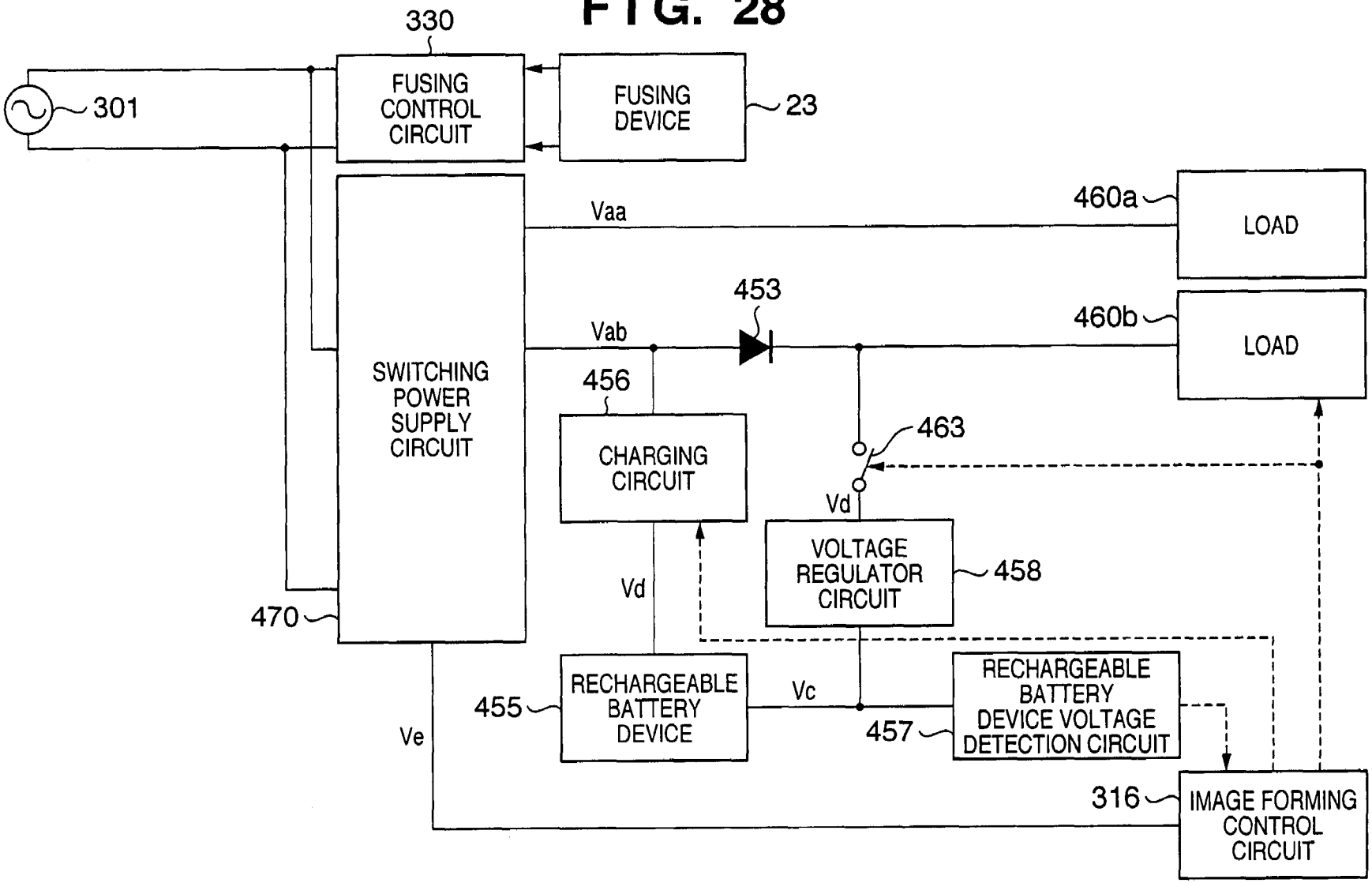
FIG. 28 is a block diagram showing the arrangement of a power supply control system of a laser beam printer according to a sixth embodiment.

For example, as shown in FIG. 28, a switching power supply circuit 470 is provided with two or more output systems including Vaa and Vab. A load 460*a* is connected to Vaa, and Vab and a rechargeable battery device 455 are connected to a load 460*b* through a voltage regulator circuit 458. In this arrangement, from the viewpoint of the overall loads except for the fusing device 23, both the commercial power supply 301 and the rechargeable battery device 455 are concurrently used as power supply sources for the loads 406*a* and 406*b*.

Figure 29:
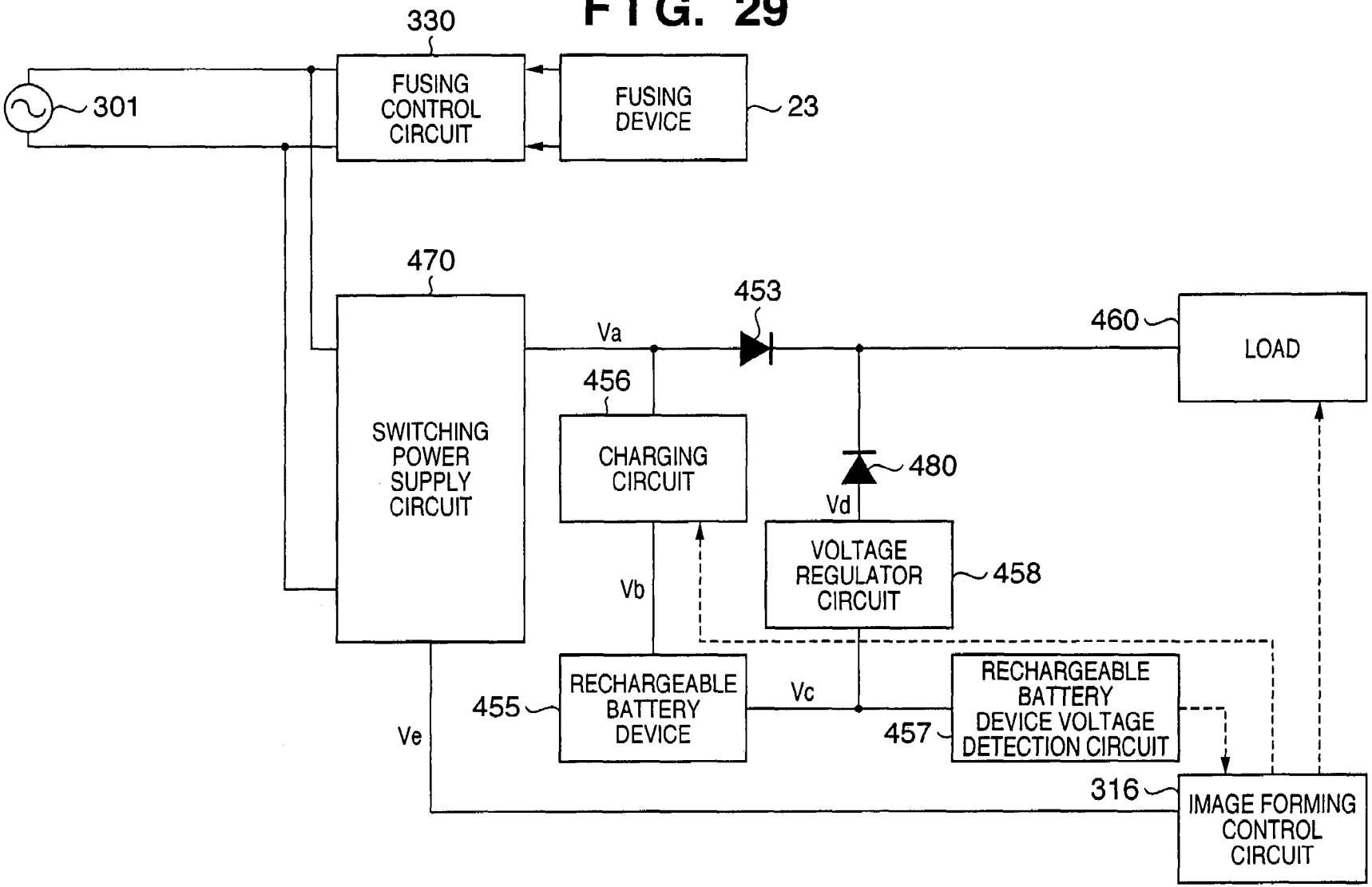
FIG. 29 is a block diagram showing the arrangement of the power supply control system of a laser beam printer according to a modification to the sixth embodiment.

Alternatively, there is provided a modification without the switch 463. For example, as shown in FIG. 29, a diode 480 is provided in place of the switch 463. In this case, power from the rechargeable battery device 455 can be preferentially supplied to a load 460 by causing the voltage regulator circuit 458 to set a voltage Vd, controlled to a voltage necessary for the operation of the load 460, higher than an output voltage Va of the switching power supply circuit 470. Note that a diode 453 on the output side of the switching power supply circuit 470 functions to prevent a current from flowing backward from the voltage regulator circuit 458 to the switching power supply circuit 470 under a condition of Vc>Va while a voltage Vc is applied from the rechargeable battery device 455 to the load 460 through the voltage regulator circuit 458. The diode 480 on the output side of the voltage regulator circuit 458 functions to prevent a current from flowing backward from the switching power supply circuit 470 to the voltage regulator circuit 458 when the voltage Vc applied from the rechargeable battery device 455 through the voltage regulator circuit 458 drops or a control error occurs. If, however, the voltage regulator circuit 458 includes a diode equivalent to the diode 480, the diode 480 is not required.

In this arrangement, when the charged voltage Vc of the rechargeable battery device 455 drops to a voltage which cannot be stepped up to the desired voltage Vd by the voltage regulator circuit 458, the power supply source for the load 460 is switched to a commercial power supply 301. At this switching timing, power from the commercial power supply 301 and power from the rechargeable battery device 455 are concurrently used.

Assume that there is provided a current limit circuit which limits the current value that can be output from the voltage regulator circuit 458 to a predetermined value. In this case, when a current equal to or more than the current limit value is to be consumed on the load side due to a load fluctuation, the current limit circuit operates to slightly decrease the output voltage from the voltage regulator circuit 458. In this case, when a drop in the output voltage from the voltage regulator circuit 458 balances with the output voltage of the switching power supply circuit 470, power from the commercial power supply 301 and power from the rechargeable battery device 455 are concurrently used.

Note that each embodiment described above, as an example of a rechargeable battery device, a plurality of electric double-layer capacitors are used. Obviously, however, in consideration based on operating conditions, sequences, and the like, in place of this rechargeable battery device, each embodiment can use, as a rechargeable battery means, a plurality of large-capacity aluminum electrolytic capacitors, other capacitors or a secondary battery (a plurality of them, as needed) such as a nickel-hydrogen battery, lithium battery, or proton polymer battery. The maximum charge/discharge counts of secondary batteries other than a proton polymer battery are generally as small as 500 to 1,000. If, therefore, the service life of a secondary battery is shorter than that of the apparatus, the battery is preferably used as a detachable replacement part.

In general, capacitors such as an electric double-layer capacitor are low in energy density and can charge and discharge large currents. In contrast, secondary batteries are higher in energy density than capacitors and do not suitably charge or discharge large currents. In order to make the most of the characteristics of both the capacitor and the secondary battery, they may be used in combination. More specifically, for a load in which a large current flows instantaneously and a small current continues to flow thereafter, energy for the large current can be provided from the capacitor and that for the small current can be provided from the secondary battery.

As a power limiting means for the fusing control circuit, the technique of determining a limit value on the basis of a current flowing in the fusing control circuit has been exemplified. Obviously, however, the same effects as described above can be obtained by determining a voltage or power input to the fusing control circuit as a limit value.

Each embodiment described above has exemplified the tandem type color image forming apparatus as an image forming apparatus, and has exemplified the fusing device based on the electromagnetic induction heating system or ceramic sheet heater system as a fusing device. However, the image forming apparatus of the present invention is not limited to this apparatus, and the present invention may be applied to image forming apparatuses having other arrangements, e.g., a color image forming apparatus and monochrome image forming apparatus having other arrangements. Obviously, in addition, the fusing device of the present invention is not limited to the fusing device described in each embodiment, and effects similar to those described above can be obtained by using fusing devices based on other systems.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-028531 filed on Feb. 4, 2004, which is hereby incorporated by reference herein.

What is claimed is:

1. A control method for an image forming apparatus including a fusing unit, having a heating element to which power from a commercial power source is supplied, configured to fuse a toner image formed on a transfer material, a rechargeable battery capable of supplying power to a load different from the heating element, and a converter configured to convert power from the commercial power source into a DC voltage which can be supplied to the load, comprising:

a remaining amount detecting step of detecting a remaining amount of power of the rechargeable battery; and a control step of controlling supply of power from the commercial power source to the heating element, wherein the supply of power from the commercial power source to the heating element which is not supplied with power from the rechargeable battery is controlled in accordance with the remaining amount of power of the rechargeable battery detected in said remaining amount detection step.

2. The method according to claim 1, wherein when the detected remaining amount of power of the rechargeable battery at power-on or upon returning from an energy saving state is not less than a predetermined amount, power is supplied from the rechargeable battery to the load, and then the detected remaining amount of power of the rechargeable battery becomes less than the predetermined amount, supply of power from the rechargeable battery to the load is interrupted and an upper limit of the power supplied from the commercial power source to the heating element is reduced.

3. The method according to claim 1, further comprising a temperature detection step of detecting a temperature of the fusing unit, wherein in said control step, the power supplied from the commercial power source to the heating element is controlled based on the temperature of the fusing unit detected in said temperature detection step, within the range up to an upper limit of the power supplied from the commercial power source to the heating element.

4. The method according to claim 1, wherein when the detected remaining amount of power of the rechargeable battery at power-on or upon returning from an energy saving state is not less than a predetermined amount, power is supplied from the rechargeable battery to the load, and when the detected remaining amount of power of the rechargeable battery at power-on or upon returning from the energy saving state is less than the predetermined amount, power is not supplied from the rechargeable battery to the load and an upper limit of the power supplied from the commercial power source to the heating element is reduced.

5. The method according to claim 1, wherein the image forming apparatus further includes a voltage regulator circuit which regulates an output voltage from the rechargeable battery to a predetermined level, and wherein the remaining amount of power of the rechargeable battery is detected in said remaining amount detection step by measuring the output voltage from the rechargeable battery, and wherein the predetermined amount corresponds to a voltage level which can be regulated into the predetermined level by the voltage regulator circuit.

6. An image forming apparatus comprising:

a fusing unit, having a heating element to which power from a commercial power source is supplied, and configured to fuse a toner image formed on a transfer material;

a rechargeable battery capable of supplying power to a load other than the heating element;

a converter configured to convert power from the commercial power source into a DC voltage which can be supplied to the load;

a remaining amount detector configured to detect a remaining amount of power of said rechargeable battery; and a controller configured to control supply of power from the commercial power source to the heating element, wherein said controller controls the supply of power from the commercial power source to the heating element which does not receive power from said rechargeable battery, in accordance with the remaining amount of power of the rechargeable battery detected by said remaining amount detector.

7. An image forming apparatus according to claim 6, wherein when the detected remaining amount of power of said rechargeable battery at power-on or upon returning from an energy saving state is not less than a predetermined amount, power is supplied from said rechargeable battery to the load, and then the detected remaining amount of power of said rechargeable battery becomes less than the predetermined amount, supply of power from said rechargeable battery to the load is interrupted and an upper limit of the power supplied from the commercial power source to the heating element is reduced.

8. An image forming apparatus according to claim 6, further comprising a temperature detector for detecting a temperature of said fusing unit, wherein said controller controls the power supplied from the commercial power source to the heating element based on the temperature of said fusing unit detected by said temperature detector, within the range up to an upper limit of the power supplied from the commercial power source to the heating element.

9. An image forming apparatus according to claim 6, wherein when the detected remaining amount of power of the rechargeable battery at power-on or upon returning from an energy saving state is not less than a predetermined amount, power is supplied from said rechargeable battery to the load, and when the detected remaining amount of power of said rechargeable battery at power-on or upon returning from the energy saving state is less than the predetermined amount, power is not supplied from said rechargeable battery to the load and an upper limit of the power supplied from the commercial power source to the heating element is reduced.

10. An image forming apparatus according to claim 6, further comprising a voltage regulator circuit which regulates an output voltage from said rechargeable battery to a predetermined level, and wherein the remaining amount of power of said rechargeable battery is detected by said remaining amount detector by measuring the output voltage from said rechargeable battery, and wherein the predetermined amount corresponds to a voltage level which can be regulated into the predetermined level by said voltage regulator circuit.

* * * * *

UNITED STATES PATENT AND TRADEMARK OFFICE

CERTIFICATE OF CORRECTION

PATENT NO. : 7,277,651 B2
APPLICATION NO. : 11/046816
DATED : October 2, 2007
INVENTOR(S) : Hidetoshi Hanamoto et al.

It is certified that error appears in the above-identified patent and that said Letters Patent is hereby corrected as shown below:

COLUMN 1:
Line 35, "a" should read --an--.

COLUMN 5:
Line 10, "to" should read --to a--.

Signed and Sealed this

Twentieth Day of May, 2008

JON W. DUDAS
*Director of the United States Patent and Trademark Office*